United States Patent [19]

Van Doorn et al.

[11] Patent Number: 4,463,669

[45] Date of Patent: Aug. 7, 1984

[54] SYSTEM FOR BALING TEXTILE WASTE FROM A PLURALITY OF SOURCES

[75] Inventors: Donald W. Van Doorn; James B. Hawkins; Francis W. Carpenter, III; Wilbur G. Hudson; Tommy W. Webb; William S. Phillips; Thomas J. Tompa; Edward Sanders, Jr., all of Columbus, Ga.

[73] Assignee: Lummus Industries, Inc., Columbus, Ga.

[21] Appl. No.: 514,904

[22] Filed: Jul. 18, 1983

[51] Int. Cl.[3] ..... B30B 15/30

[52] U.S. Cl. ..... 100/43; 53/529; 100/3; 100/45; 100/49; 100/50; 100/53; 100/91; 100/99; 100/215; 100/229 R; 100/246; 141/67; 141/80; 141/233; 141/286

[58] Field of Search ..... 100/3, 43, 45, 48, 49, 100/80, 91, 53, 99, 50, 246, 252, 229 R, 215, 269 R, 295; 53/529; 141/67, 80, 286, 233

[56] References Cited

U.S. PATENT DOCUMENTS

| | | | |
|---|---|---|---|
| 2,728,287 | 12/1955 | Tillinghast | 100/229 R X |
| 3,613,559 | 10/1971 | Buisson | 100/49 |
| 3,765,147 | 10/1973 | Ippolito | 100/49 X |
| 3,992,905 | 11/1976 | Oberley | 100/215 X |
| 4,318,264 | 3/1982 | Rewitzer | 100/246 X |
| 4,324,176 | 4/1982 | McCormick | 100/3 |
| 4,408,438 | 10/1983 | Rewitzer | 53/529 X |

FOREIGN PATENT DOCUMENTS

| | | | |
|---|---|---|---|
| 579538 | 6/1933 | Fed. Rep. of Germany | 100/215 |
| 479798 | 4/1953 | Italy | 100/229 R |
| 574671 | 3/1958 | Italy | 100/229 R |

*Primary Examiner*—Billy J. Wilhite

*Attorney, Agent, or Firm*—Woodford R. Thompson, Jr.

[57] ABSTRACT

A system for segregating and baling textile wastes supplied from a plurality of separate sources embodies a plurality of filling stations which receive the wastes from the separate sources. An upwardly opening portable waste receiving bin is mounted within each filling station with the lower end of each bin carrying a detachable bottom platen. A transfer mechanism moves each bin selectively, back and forth between its filling station and a compression station where the wastes are compressed within the bin. Actuator units in the compression station disconnect the bin from its platen and raise the bin to an upper position about a movable ram to thus expose the bale for final bale out.

37 Claims, 33 Drawing Figures

FIG. 15
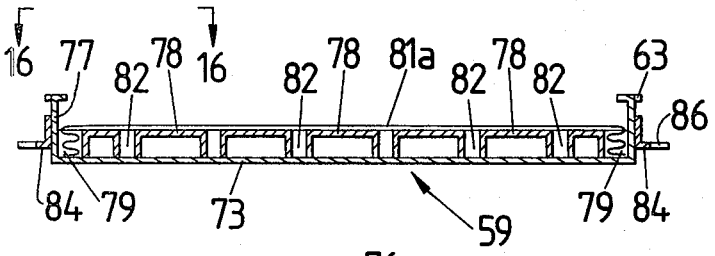
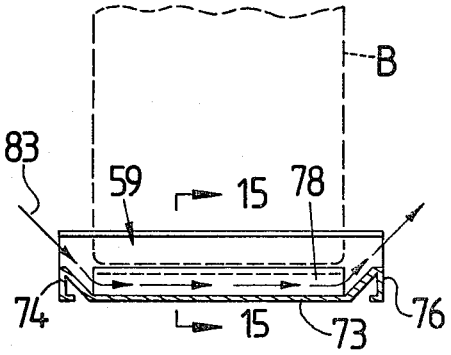
FIG. 14
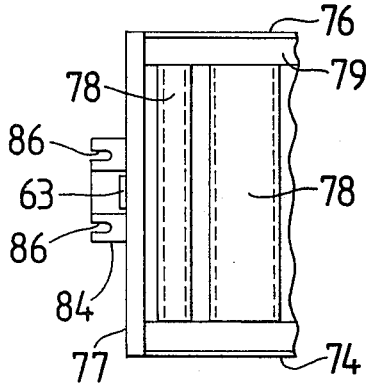
FIG. 16
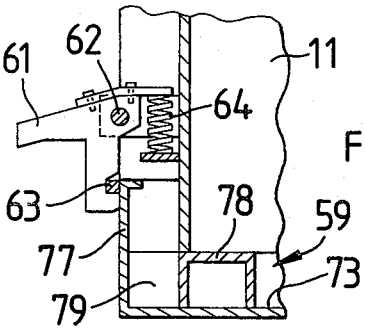
FIG. 17
FIG. 18
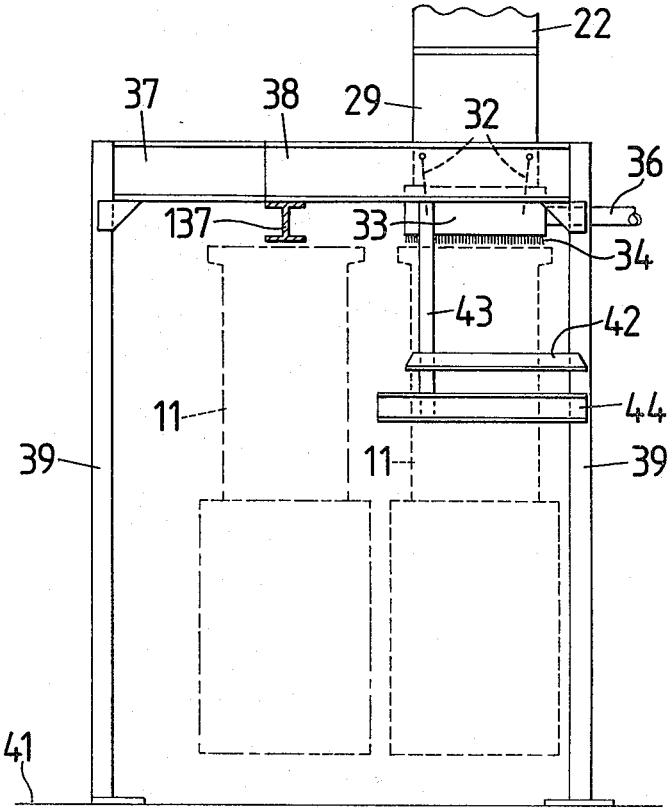

141b
144
137
144
141a
157
153
154
143
147
146a
156
152b
161
11
153
156
152a 152a
163
162
152b
158
163
156
11
151
24
158
163
156
163
152a
24
162
152b 137
149
148
140
143
146b
23
25
25
144
156
168
178
161
153
147
152b
141b
71
159
151
142
153
147
152b
144
146a
156
143
139
23
22
22
154
11

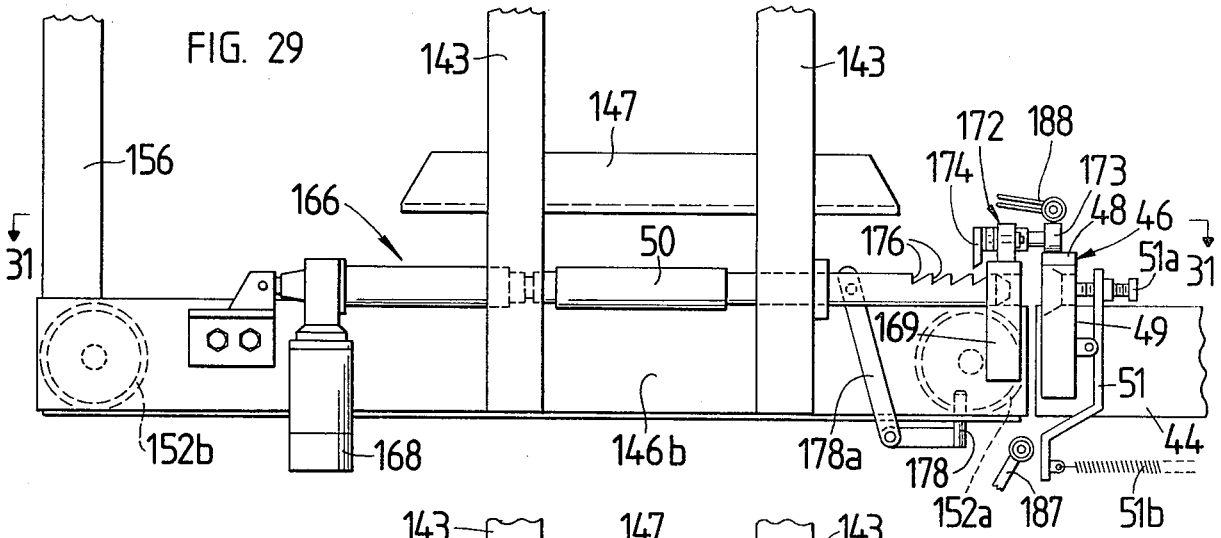
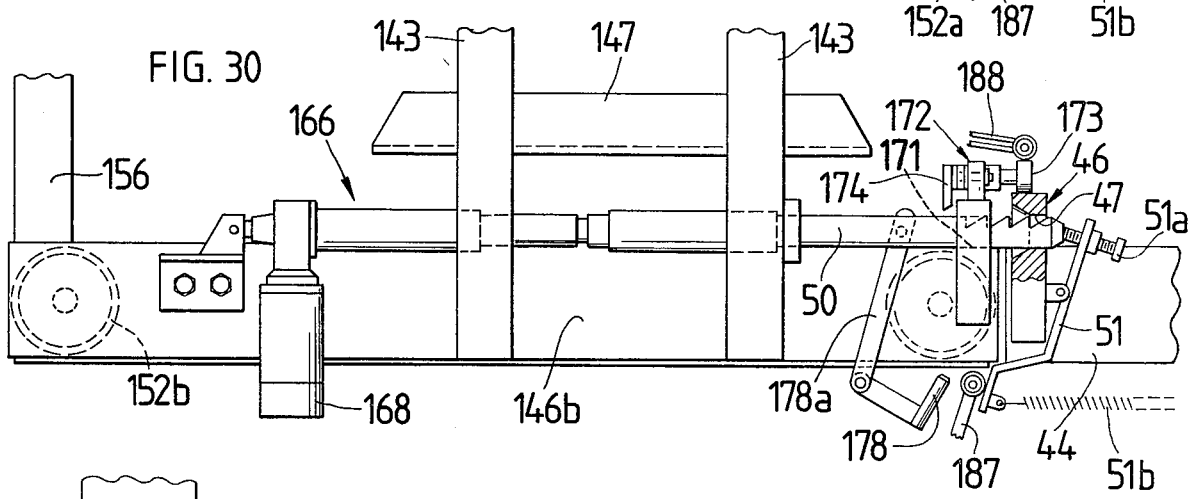
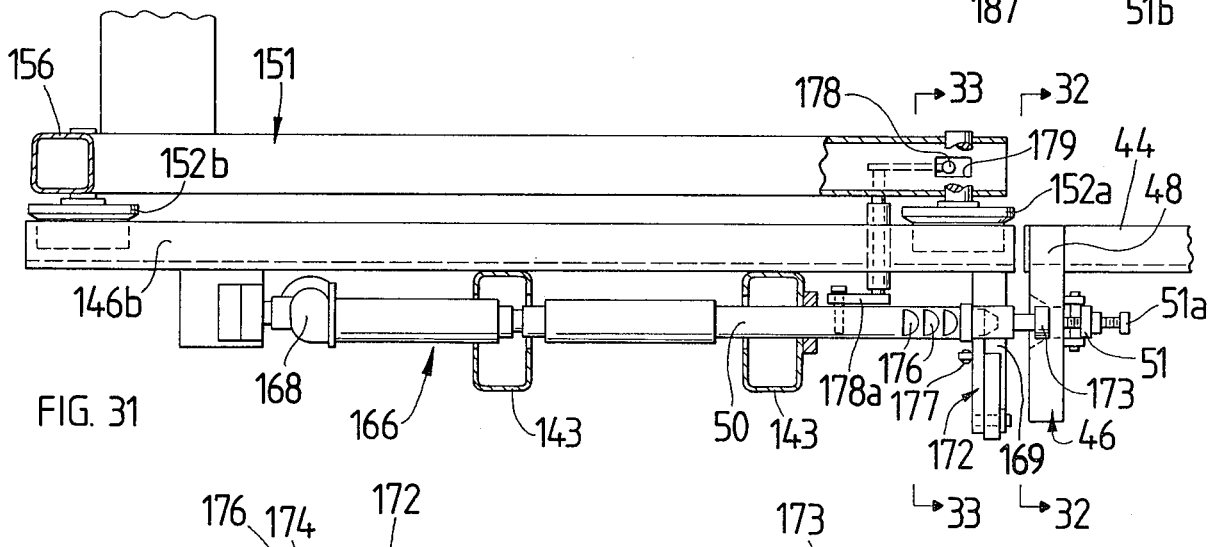
FIG. 31
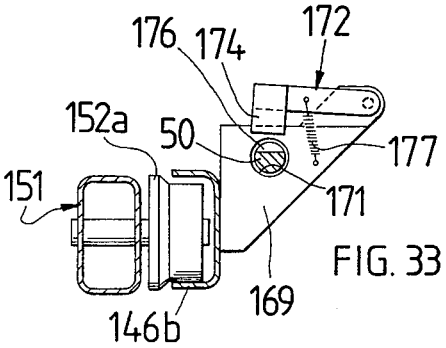
FIG. 33
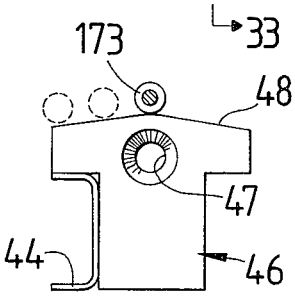
FIG. 32

SYSTEM FOR BALING TEXTILE WASTE FROM A PLURALITY OF SOURCES

BACKGROUND OF THE INVENTION

This invention relates to a textile waste baling system and more particularly to an improved textile waste baling system which economically and efficiently segregates, precompresses and compresses textile waste fibers supplied from a plurality of sources into final bales of uniform size and density.

As is well known in the art to which our invention relates, textile wastes have traditionally been compacted and baled out in very simple baling presses with extensive manual handling of the wastes. Most textile mills have waste rooms where the textile wastes are accumulated in carts or bins. When carts are used, the wastes are usually moved manually from their generating points throughout the mill to the waste room. In recent years, high vacuum air pumps communicating with relatively small diameter pipes have been employed to pneumatically convey the textile wastes from their generating points to the waste room where the waste is drawn by the vacuum pumps into collection tanks mounted over the bins and/or carts. These collection tanks are then intermittently dumped into the carts or bins when they have received a full charge of waste. The wastes are then moved manually in the carts or bins to a waste baling press for final bale out.

Recently, it has been found that exposure to raw cotton dust and fibers can be very detrimental to the health of the personnel handling the textile wastes. Long periods of exposure to such waste can cause respiratory diseases in the form of bysinossis or brown lung which permanently impairs a person's breathing. As a result, the Occupational Safety and Health Administration has passed tentative restrictions banning personnel from the direct manual handling of cotton waste. To meet these requirements, conventional pneumatic waste conveying systems have been combined with automatic waste pick-up devices and horizontal balers mounted underneath the collection tanks of pneumatic conveying systems. This type combined system provides a partial answer to the problem of safely collecting textile wastes without any direct manual handling of the cotton fibers. However, most textile mills receive significant amounts for their waste when properly segregated into various groups desired by the consumers of waste. Accordingly, a minimum of three or four segregations of waste will bring significantly higher returns than a mixture of the various wastes. In some cases, it is desirable to segregate as many as ten or twelve wastes for optimum resale value of the waste.

With conventional pneumatic conveying systems combined with horizontal balers, a large capital investment is required to segregate wastes because a separate horizontal baler is needed for each different type of waste collected. Also, horizontal balers require a relatively large floor space and when a plurality of wastes are collected, floor space becomes an important factor. Furthermore, horizontal balers do not produce as desirable a bale as the traditional vertical balers employed with manually operated waste collecting systems. Another disadvantage in horizontal balers is that some automated bale plucking systems used by the consumers of waste require the bales handled by such systems to be of a uniform size and density and that they be stable on their bases. They also require that such bales do not expand excessively in height when released to their ties. Bales made with horizontal balers generally do not meet these requirements.

A still further disadvantage in the use of horizontal balers is that the inlets to such balers are normally much smaller than the conduits of the waste conveying system that discharges the waste into the baler. This requires expensive, elevated hoppers between the large outlets of the waste conveying system and the inlets to the balers. Accordingly, conventional pneumatic conveying systems combined with horizontal baling systems must be installed in buildings with very high ceilings.

SUMMARY OF THE INVENTION

In accordance with our present invention, we overcome the above and other difficulties by providing an improved textile waste baling system which economically and efficiently segregates, precompresses and compresses textile waste supplied from a plurality of separate sources into bales of uniform size and density. Our improved waste baling system incorporates essentially three basic components: (1) a plurality of waste fiber filling stations which receive the waste fibers from a plurality of generating points throughout the mill and discharge the same into a portable waste receiving bin within each filling station; (2) a main compression station which is designed to selectively precompress and apply final compression to the waste fibers; and (3) a transfer mechanism which is adapted to move each portable bin selectively to and from its filling station and the compression station.

An important feature of our improved textile waste baling system is that a single compression station acts both to precompress the waste in the portable bins as well as to make the final bale. That is, the portable bins in our improved system not only accumulate the waste fibers but also act as the confining walls for making the final bales in the compression station. In other words, the waste fibers are not transferred from the portable bins until the final bale is produced.

Another object of our invention is to provide an improved textile waste fiber baling system which minimizes human exposure to textile wastes and at the same time segregates a plurality of different types of waste into separate groups that produce optimum resale values when compacted into final bales.

Another object of our invention is to provide a textile waste baling system which produces final bales that are stable on their bases and do not expand excessively in height when released to their ties thereby meeting the general requirements of conventional automated bale plucking systems.

Yet another object of our invention is to provide a textile waste baling system which requires a lower capital investment and significantly less floor space than required by conventional pneumatic conveying systems combined with horizontal compacting systems.

A further object of our invention is to provide an improved textile waste baling system wherein the compressed final bale is quickly and easily exposed for tying out and removal without the need for any additional exit doors or complicated extrusion equipment.

Still another object of our invention is to utilize the long time interval resulting from the slow rates at which some of the waste fibers are collected in the portable bins to allow a single transfer mechanism to move the portable bins from their filling stations to the compression station for precompression and final compression of the waste fibers without exceeding the capacity of the single compression station or the transfer mechanism.

DESCRIPTION OF THE DRAWINGS

Apparatus embodying features of our invention is illustrated in the accompanying drawings, forming a part of this application, in which:

FIG. 14 is an enlarged, sectional view taken generally along the line 14—14 of FIG. 8;

FIG. 15 is a sectional view taken generally along the line 15—15 of FIG. 14;

FIG. 16 is a fragmental, top plan view taken generally along the line 16—16 of FIG. 15;

FIG. 17 is an enlarged, fragmental sectional view showing a spring biased latch detachably connecting a portable bin to its bottom platen;

FIG. 18 is a vertical sectional view taken generally along the line 18—18 of FIG. 6;

FIG. 29 is an enlarged, fragmental side elevational view showing a locking unit carried by the transfer mechanism in its retracted position;

FIG. 30 is a fragmental, elevational view corresponding to FIG. 29 showing the locking unit in its extended position;

FIG. 31 is a fragmental, top plan view, partly in section, taken generally along the line 31—31 of FIG. 29;

FIG. 32 is an elevational view taken generally along the line 32—32 of FIG. 31; and FIG. 33 is a fragmental, sectional view taken generally along the line 33—33 of FIG. 31.

DETAILED DESCRIPTION

Figure 1:
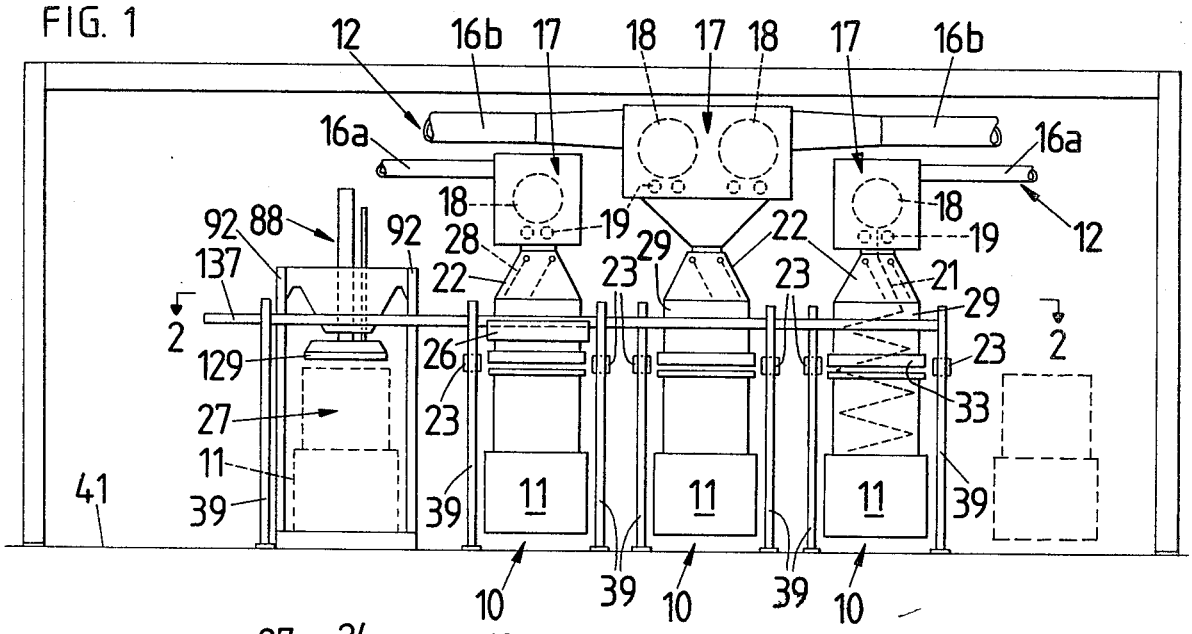
FIG. 1 is an elevational view showing our improved system for baling textile waste fibers from a plurality of sources.

Referring now to the drawings for a better understanding of our invention, we show in FIGS. 1-5 our improved system as including a plurality of waste fiber filling stations, indicated generally at 10, with each filling station having an upwardly opening portable waste receiving bin 11. A pneumatic waste fiber conveying system, indicated generally at 12, is employed to convey the various types of waste fibers from their separate generating points throughout the mill to the waste fiber filling stations 10.

The pneumatic conveying system 12 may consist of a plurality of small diameter pipes **16*a* and 16*b* which extend between the separate waste generating points, not shown, and a discharge sentry 17 mounted above each waste fiber filling station 10. Suitable high vacuum air pumps, not shown, draw the waste fibers from their separate generating points through the pipes 16*a* and 16*b* into the discharge sentries 17 where they are collected on the outer surface of at least one screen drum 18 mounted for rotation within each discharge sentry. When the pressure drop across the layer of fibers collected on each screen drum 18 builds up to a predetermined point, a predetermined volume of waste fibers are deposited on the drum. Conventional doffer rolls 19 are then activated to remove the condensed batt of waste fibers from the rotating screen drum, as shown. The continuous strip of condensed fibers, indicated at 21, then falls downwardly into a conventional oscillating deflector unit 22**.

Mounted on the side of each filling station 10 is a sensing element 23 for each filling station 10 which is adapted to sense when any one of the filling stations 10 has received sufficient material for precompression or final compression. For example, the element 23 senses the level of the material in the filling stations 10. Once the sensing element 23 recognizes a full filling station 10, it then conveys this information to a conventional programmable controller 24 for the entire baling system. The programmable controller 24 then takes this information and signals a bin transfer mechanism, indicated generally at 26. One source of textile waste fibers comes from the combing operation. In the combing operation, the wastes developed are called comber noils. In a mill that combs cotton fibers, there will be several banks of combing machines and there will be down time on each one of these machines throughout the day. When any one of the machines is actually operating, however, it will be developing combing noils at a very predictable rate. By mounting a sensor, not shown, at each combing machine which is operatively connected to the programmable controller 24 and indicates when the combing machine is actually running, the total accumulative run time of the combing machine can be actually determined. When the material in the filling station 10 receiving the combing noils reaches a predetermined level during a period of actual accumulative run time of the combing machine, the programmable controller 24 will signal the bin transfer machanism 26, to move that particular bin 11 to a compression station, indicated at 27, for precompression of the fibers within the bin or for final compression of the fibers to form a final bale. It will be apparent to one skilled in the art that other means may be employed to indicate when any one of the filling stations has received sufficient material for precompression or final compression.

Figure 6:
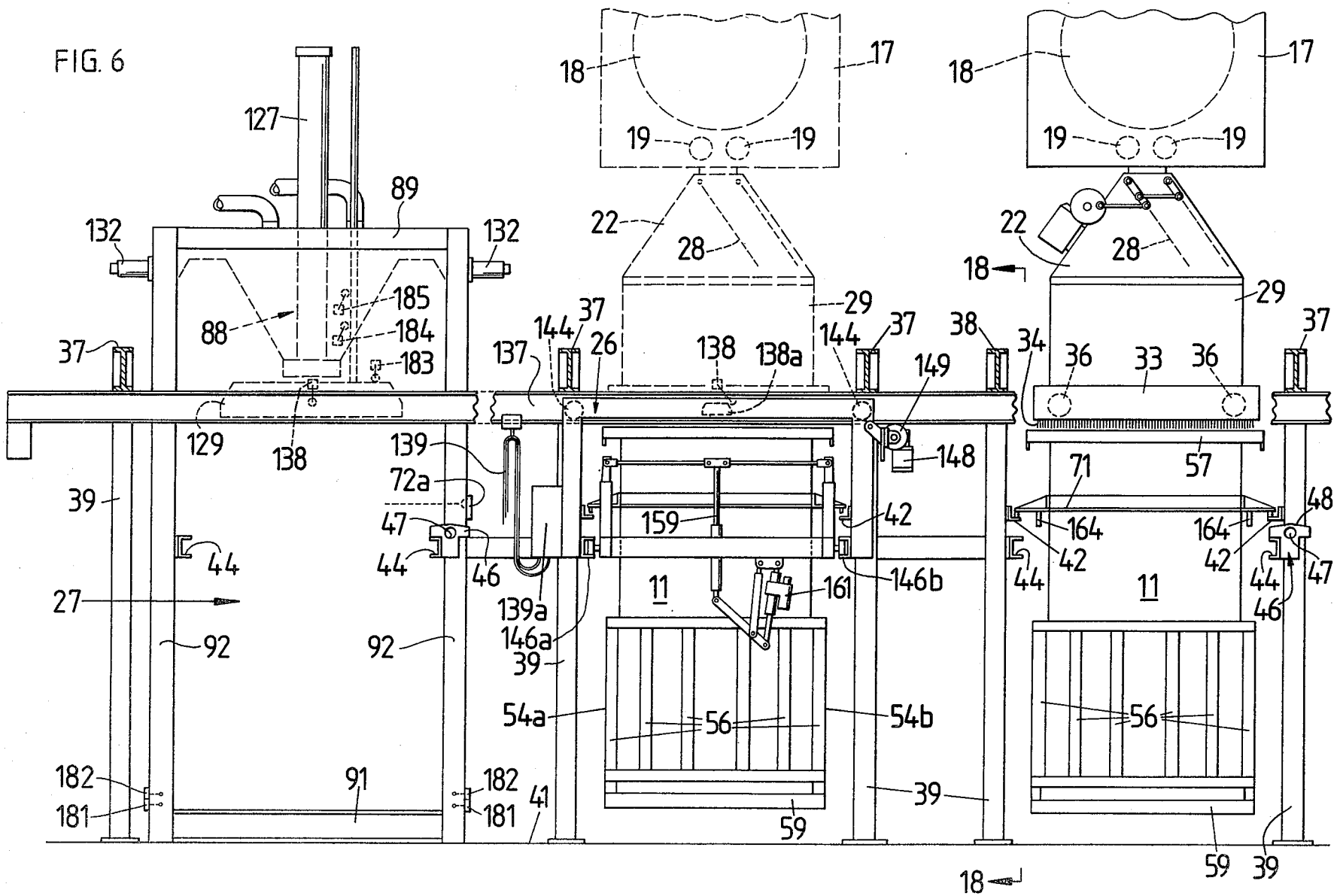
FIG. 6 is an enlarged, fragmental view, partly in section, taken generally along the line 6—6 of FIG. 3.

As shown in FIGS. 1 and 6, each oscillating deflector unit 22 is provided with a pair of depending deflector elements 28 which are pivotally connected to the upper end of the deflector unit. The deflector elements 28 are adapted to swing back and forth in the usual manner to cause the condensed batt of waste fibers 21 removed from each screen drum 18 to pass downwardly through a stationary hopper 29 mounted beneath each deflector unit 22 and form transverse folds of waste fibers in each portable bin 11, as shown in FIG. 1. Mounted within each stationary hopper 29 is a pair of doors 32 which are pivotally connected at their upper ends to the side walls of each hopper 29, as shown in FIG. 18. The doors 32 normally stay in a downwardly extending position to permit the waste fibers 21 to pass from the oscillating deflector unit 22 above the hopper into the portable bin 11 below. However, when the portable bin 11 in a particular filling station 10 is moved to the compression station 27, the doors 32 are pivoted to a horizontal closed position to collect the waste fibers 21 in the hopper until the portable bin is returned to its filling station.

As shown in FIGS. 6 and 18, a conventional scavenger sleeve 33, having the usual flexible sealing elements 34 on its lower end, is mounted at the lower end portion of each stationary hopper 29 in position to form a seal at the upper end of its portable bin 11. The scavenger sleeve 33 is connected to a conventional vacuum system, indicated at 36, which creates a negative pressure within each sleeve 33 to prevent dust, waste fibers and the like from escaping to the atmosphere.

Figure 25:
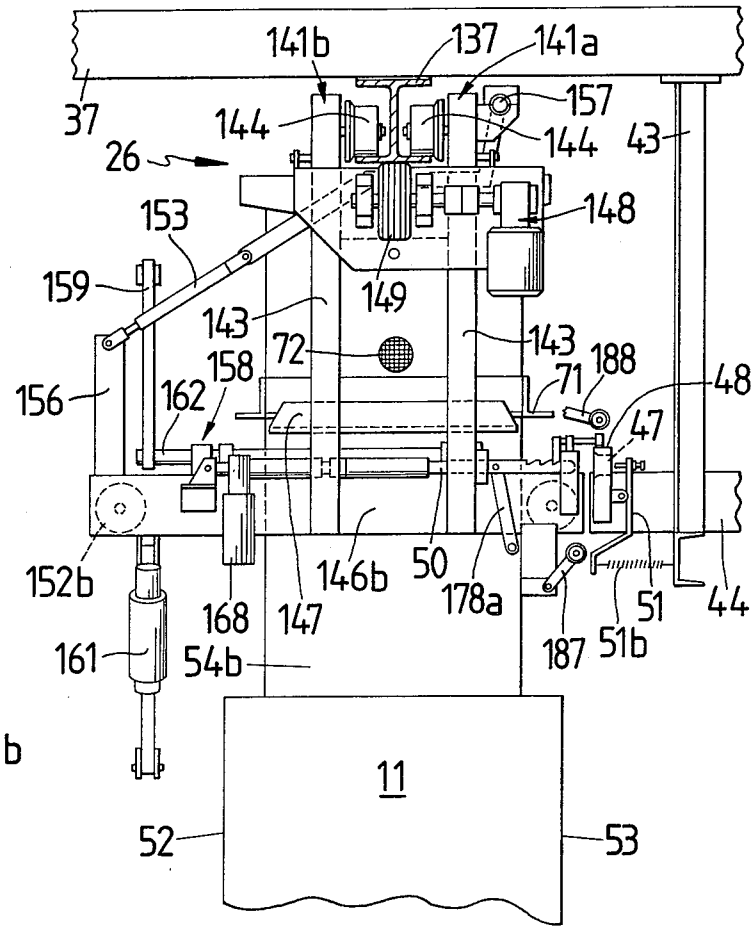
FIG. 25 is a side elevational view, partly in section, taken generally along the line 25—25 of FIG. 19 and showing the transfer mechanism in its fully retracted position.

As shown in FIGS. 2–6 and 18, laterally spaced cross beams 37 and 38 are secured to the upper end portions of spaced apart columns 39 at the ends of each filling station 10. The cross beams 37 and 38 support the stationary hoppers 29 above and in spaced relation to a floor or supporting surface 41 for the filling stations 10. As shown in FIG. 6, a pair of laterally spaced bin support rails 42 are provided at each end of each filling station 10 to support its portable bin 11 above the floor 41 in a manner to be described hereinafter. As shown in FIGS. 18 and 25, vertical angle-like members 43 depend from the cross beams 37 and 38 in each of the filling stations 10 in position to support the front ends of the bin support rails 42 while the rear ends of the support rails 42 are supported by the columns 39. Mounted below each bin support rail 42 in each filling station 10 is a horizontally extending channel-shaped guide rail 44 which supports the transfer mechanism 26, in a manner to be described below, as it inserts and removes a portable bin 11 from its filling station 10.

Figure 2:
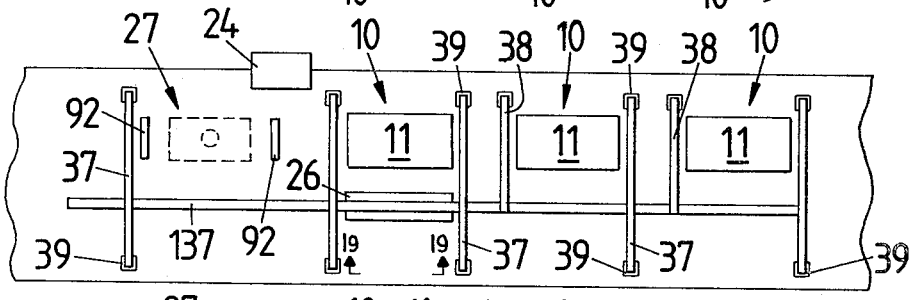
FIG. 2 is a fragmental, top plan view taken generally along the line 2—2 of FIG. 1, showing a portable waste receiving bin in each filling station.
Figure 3:
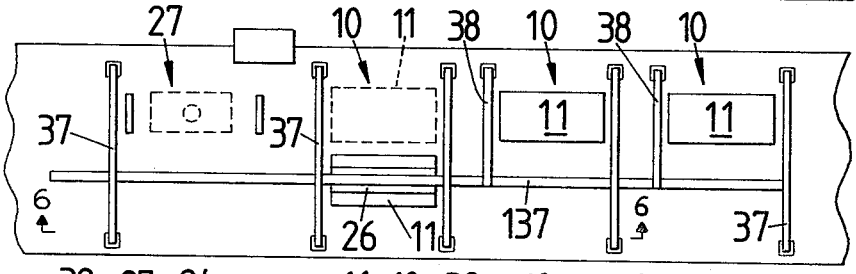
FIG. 3 is a fragmental, top plan view corresponding to FIG. 2 showing the transfer mechanism moving a portable bin toward the compression station.
Figure 4:
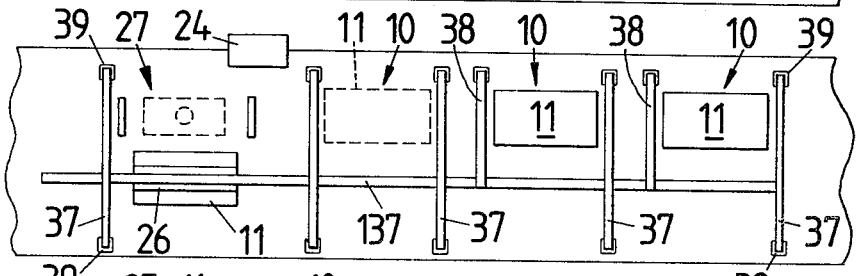
FIG. 4 is a fragmental, top plan view corresponding to FIG. 2, showing the transfer mechanism and a portable bin positioned at a predetermined location relative to the compression station.
Figure 5:
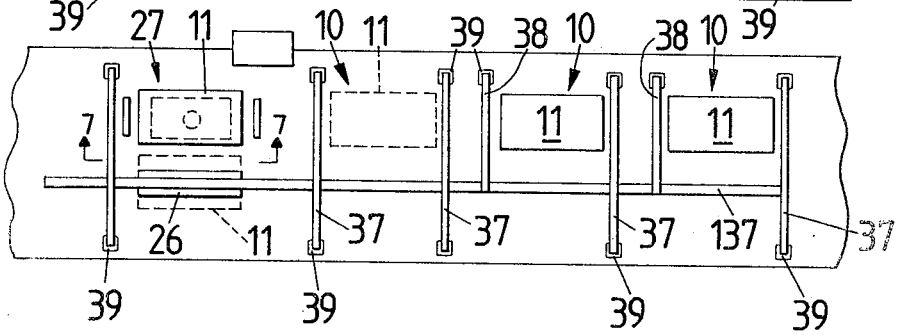
FIG. 5 is a fragmental, top plan view corresponding to FIG. 4 showing a portable bin within the compression station.

As shown in FIG. 6, a generally T-shaped vertically extending member 46 is provided in each filling station 10. Each member 46 has an opening 47 therethrough which is adapted to receive a movable locking member 50, as shown in FIGS. 29, 30 and 31, each time the transfer mechanism 26 moves to a predetermined position relative to a filling station 10, as shown in FIG. 2. An upper cam surface 48 is provided on each member 46 in position to be engaged by a cam follower carried by the transfer mechanism to stop the transfer mechanism at the predetermined position. Each member 46 is shown as being carried by the adjacent front end portion of the guide rail 44 mounted at one side of its filling station 10, as shown in FIG. 6. As shown in FIGS. 25, 29 and 30, a lever arm 51 is pivotally connected to the rear side 49 of each member 46. A threaded member 51*a* is carried by the upper portion of each lever arm 51 in alignment with the opening 47 through the vertically extending member 46 adjacent thereto. The lower end of each lever arm 51 is connected to a spring-like member 51*b* which urges the upper end of the lever arm 51 and the threaded member 51*a* toward the rear side 49 of the member 46, as shown. When the movable locking member 50 engages the opening 47 in the member 46, it pivots the upper end of the lever arm 51 away from the rear side 49 of the member 46, as shown in FIG. 30. This locks the transfer mechanism 26 in the predetermined position relative to a filling station 10, as described above.

In FIGS. 1–5 we show each upwardly opening waste receiving bin 11 as being a rectangular container having front and rear walls 52 and 53, respectively, and end walls 54*a* and 54*b*. The lower portion of each portable bin 11 is reinforced with a plurality of horizontally spaced vertical angle-like members 56 to withstand the forces exerted on the waste fibers in the bin during precompression and final compression to form a final bale, as shown in FIG. 6. A suitable outwardly and then downwardly extending flange 57 is provided around the open upper end of each bin 11 in position to engage the flexible sealing elements 34 depending from the lower end of the scavenger sleeve 33 carried by the stationary hopper 29 within its filling station 10.

Figure 10:
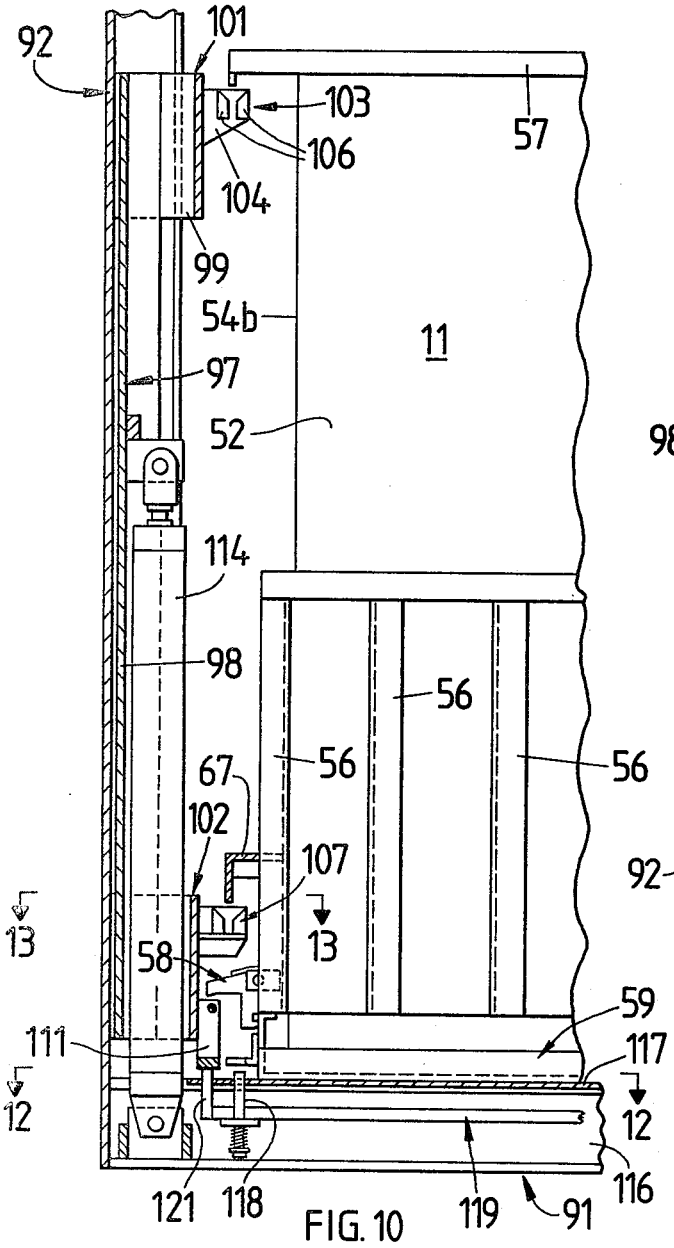
FIG. 10 is an enlarged, fragmental view, partly in section, taken generally along the line 10—10 of FIG. 9.
Figure 11:
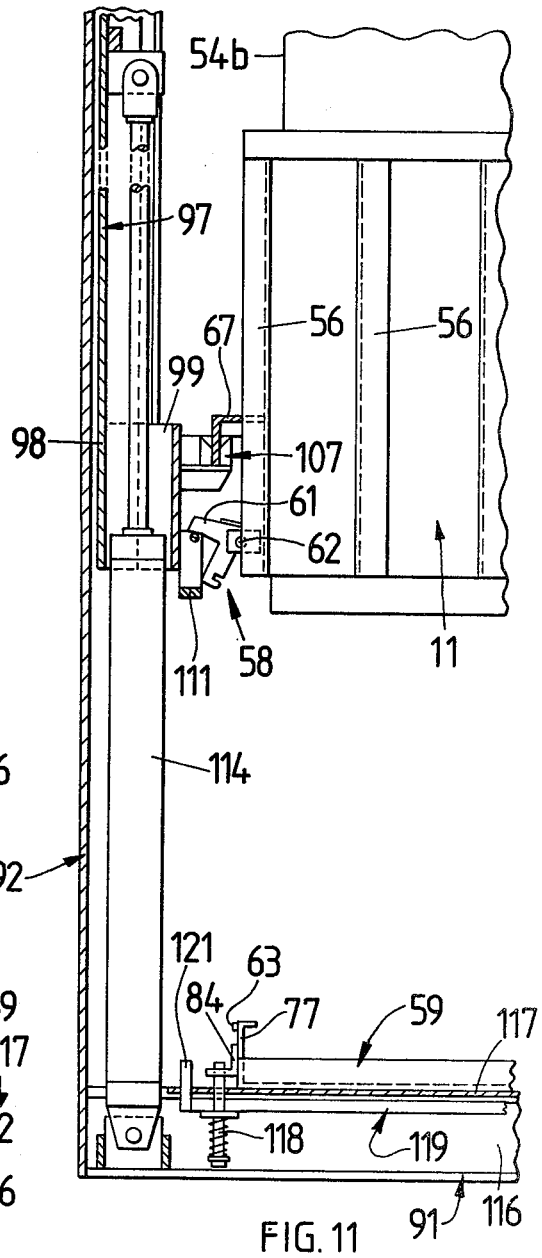
FIG. 11 is a fragmental, elevational view corresponding to FIG. 10, showing the portable bin moved to its upper position.

As shown in FIGS. 10 and 11, a latch or hook mechanism, indicated generally at 58, is mounted on the lower portions of the end walls 54*a* and 54*b* of each portable bin 11 to detachably connect each bin to a bottom platen 59. Preferably, each latch mechanism 58 comprises an inverted, generally L-shaped locking member 61 which is pivotally connected at 62 to the end walls 54*a* and 54*b* in position to pivot into engagement with a locking clip 63 carried by a subjacent portion of the platen 59. As shown in FIG. 17, a compression spring 64 urges each L-shaped locking member 61 into engagement with its locking clip 63. This arrangement positively locks each bin 11 to its bottom platen 59 until the latch mechanism 58 is automatically released in the compression station 27 by means to be described below.

Figures 26, 27:
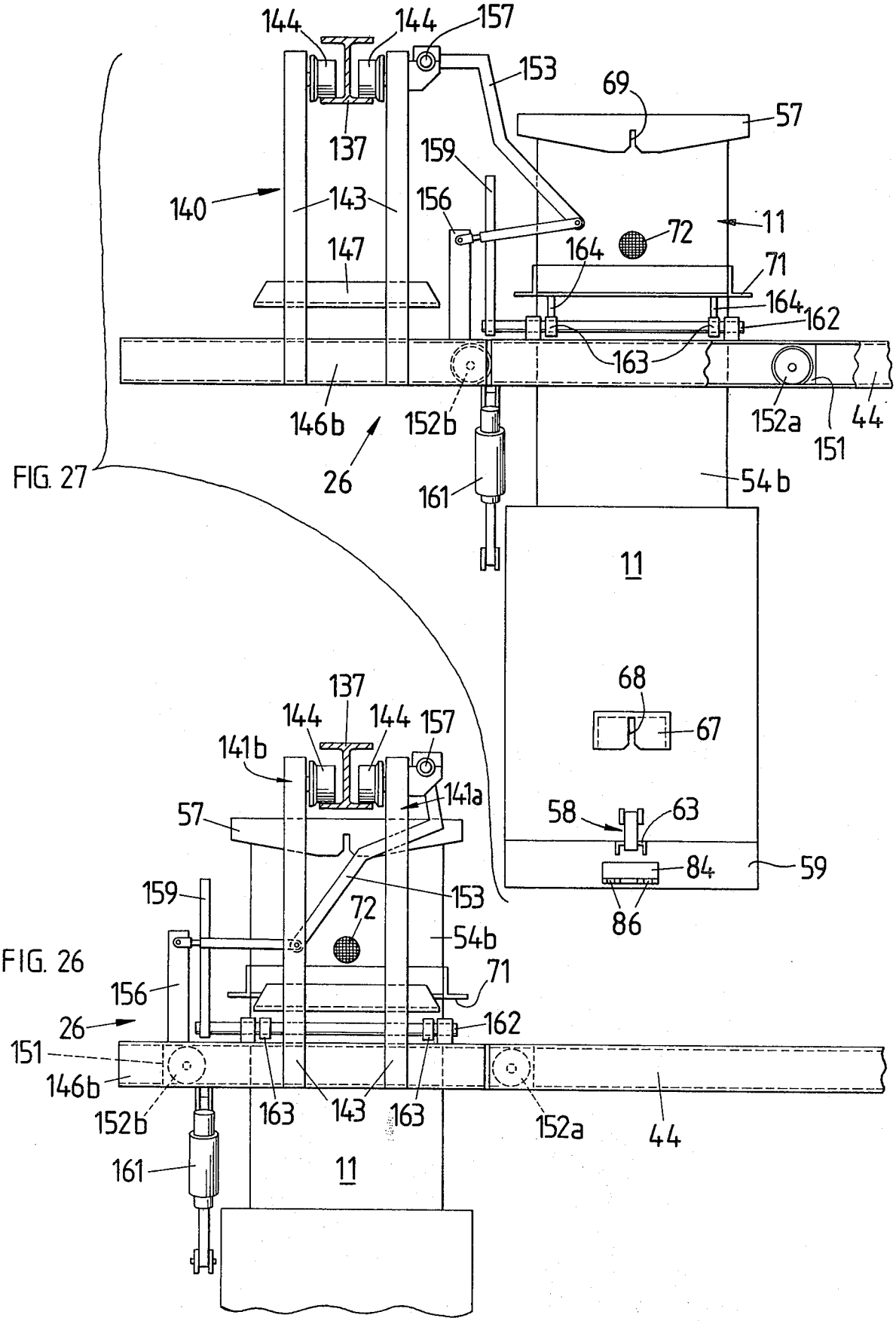
FIG. 26 is a side elevational view corresponding to FIG. 25 showing the intermediate extended position of the transfer mechanism and before it engages and moves the bin into the adjacent station.
FIG. 27 is a side elevational view corresponding to FIG. 25 showing the transfer mechanism in the fully extended position and inserting a bin into the station.

As shown in FIGS. 10, 11 and 27, an outwardly and then downwardly projecting bin lifting element 67 is secured to the end walls 54*a* and 54*b* of each bin above the inverted L-shaped locking members 61. Each lifting element 67 is provided with a downwardly opening, vertically extending notch 68 having a beveled lower end portion, as shown in FIG. 27. The notches 68 are aligned with corresponding identically constructed downwardly opening notches 69 in the flange 57 carried by the open upper end of each portable bin 11. The downwardly opening notches 68 and 69 thus define lifting points for each bin 11 which are engaged by bin lifting members 103 and 107 in the compression station 27 to lift and lower the bin in a manner to be described below.

In FIGS. 6, 7, 19, 20, 21, and 25–27, we show a laterally projecting, horizontal flange 71 carried by each portable bin 11 intermediate the upper ends of the reinforcing members 56 and the upper flange 57. The horizontal flange 71 is adapted to engage the laterally spaced horizontal bin support rails 42 carried by each filling station 10 to support the bin 11 above the floor 41. As shown in FIGS. 25–27, a light reflector element 72 is mounted on the end wall 54*b* of each bin 11 in position to cooperate with a sensing element 72*a* mounted in the compression station 27. The sensing element 72*a* determines when a bin 11 is moved to a predetermined horizontal position within the compression station 27 in a manner to be described below.

In FIG. 14–17, we show each detachable platen 59 as having a bottom member 73, front and rear walls 74 and 76 and end walls 77. A plurality of laterally spaced bale support members 78 are carried by the bottom member 73 with the ends of the members 78 being spaced from the front and rear walls 74 and 76, respectively, as shown in FIG. 14. The two outermost bale support members 78 are spaced from the end walls 77 of each platen with these spaces in combination with the spaces between the ends of the members 78 and the front and rear walls 74 and 76, respectively, defining a continuous trough 79 around the platen 59, as shown in FIG. 16. The trough 79 thus provides space for folding excess bale covering material 81*a* which extends across the upper surfaces of the bale support members 78, as shown in FIG. 15. It should be understood that the piece of bale covering material 81*a* will, in its final position, cover fully, along with a similar piece of upper covering material 81*b* shown in FIG. 8, four sides of a final bale, indicated at B, and partially or completely cover the other two sides of the bale.

As shown in FIGS. 14–16, the slots between the bale support members 78 define the usual passageways 82 which permit bale straps or ties 83 to be placed around the bottom surface of the bale once the bale covers 81*a* and 81*b* are in place. To facilitate easy passage of the ties 83 through the passageways 82, portions of the bottom member 73 between the ends of the bale support members and the front and rear walls 74 and 76, respectively, are sloped, as shown in FIG. 14.

In FIGS. 15 and 16, we show the upstanding legs of angle-like members 84 as being secured to the outer surface of the end walls 77 of each detachable bottom platen 59. Spaced apart outwardly opening slots 86 are provided in the horizontal legs of each angle-like member 84 in position to receive pin-like locking members 118 each time a portable bin 11 is inserted into and locked in a predetermined horizontal position in the compression station, as shown in FIGS. 10 and 11.

Figure 12:
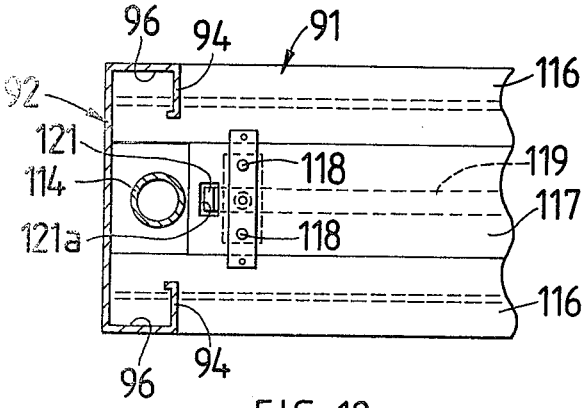
FIG. 12 is a fragmental, sectional view taken generally along the line 12—12 of FIG. 10.
Figure 13:
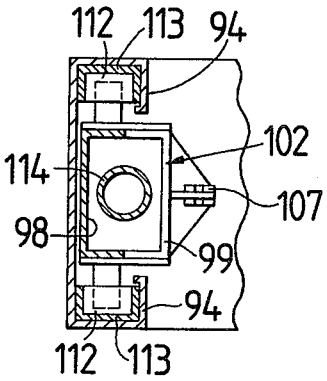
FIG. 13 is a fragmental, sectional view taken generally along the line 13—13 of FIG. 10.

As shown in FIGS. 1–6, cross beams 37 are secured to the upper portions of spaced apart columns 39 at the ends of the compression station 27. Mounted within the compression station 27 is an upstanding main frame 87 which extends above the cross beams 37 and is adapted to support a down-packing compression ram, indicated generally at 88. The main frame 87 consists of upper and lower sills 89 and 91, respectively, and two laterally spaced upstanding side columns 92. Each side column 92 is preferably formed from a channel-like member as shown in FIGS. 12 and 13. An inwardly extending flange 94 is formed integrally with the free end of each leg of each side column 92 to define longitudinally extending, inwardly opening pockets 96 along the legs of each side column.

Figure 8:
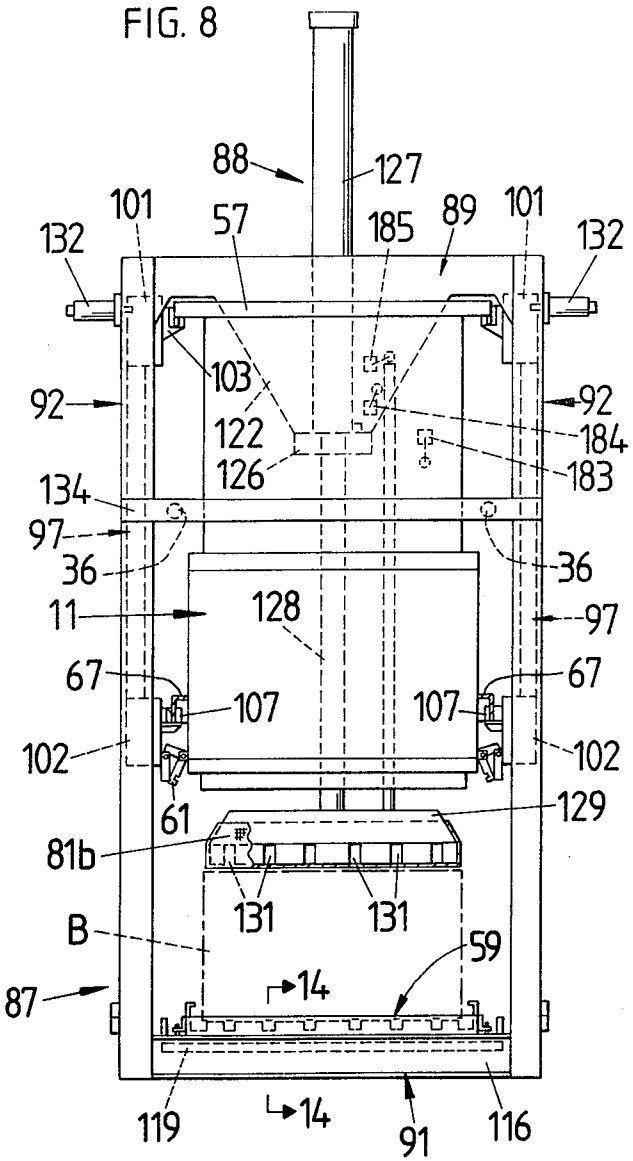
FIG. 8 is an elevational view corresponding to FIG. 7 showing a compacted bale exposed for final tying out of the bale.

As shown in FIGS. 10, 11 and 13, a bin actuating frame 97 is mounted for vertical sliding movement within each side column 92. Each actuating frame 97 is preferably formed from a channel-like member 98 which is shorter in length and narrower in width than the side columns 92. In FIGS. 10, 11 and 13, we show short lengths of channel-like members 99 secured to the upper and lower end portions of each sliding channel-like member 98. The channel-like members 99 thus define upper and lower bin lifting boxes 101 and 102, respectively. Mounted on each upper lifting box 101 is a bin lifting member 103 which is adapted to engage and move vertically within the adjacent downwardly opening notch 69 provided in the flange 57 at the upper end of an adjacent bin 11. Each bin lifting member 103 may comprise a vertical plate-like member 104 having spaced apart vertical guide members 106 secured along each side thereof. The upper end portions of the spaced apart guide members 106 are beveled to facilitate proper engagement of the bin lifting members 103 with the notches 69, as shown in FIG. 8. A bin lifting member 107, which is similar in construction to the bin lifting member 103, is mounted on the lower lifting box 102 of each actuating frame 97. The bin lifting members 107 are adapated to engage and move vertically within notches 68 in the bin lifting elements 67 each time a bin is raised to an upper position within the compression station 27, as shown in FIGS. 8 and 11.

An unlocking element 111 is mounted on each lower lifting box 102 below the bin lifting member 107, as shown in FIGS. 10 and 11. The unlocking elements 111 are adapted to engage and disconnect the locking members 61 carried by the lower portion of each bin 11 from the locking clips 63 carried by its detachable bottom platen 59 each time a bin is moved to its upper bale exposing position, as shown in FIGS. 8 and 11. As shown in FIG. 13, laterally projecting guide members 112 extend outwardly from each side of the upper and lower bin lifting boxes 101 and 102, respectively. Wear pads 113 are provided on the guide members 112 in positions to engage the inner surfaces of the pockets 96. This arrangement guides each bin actuating frame 97 along a predetermined vertical path as it slides up and down in its side column 92.

Figure 7:
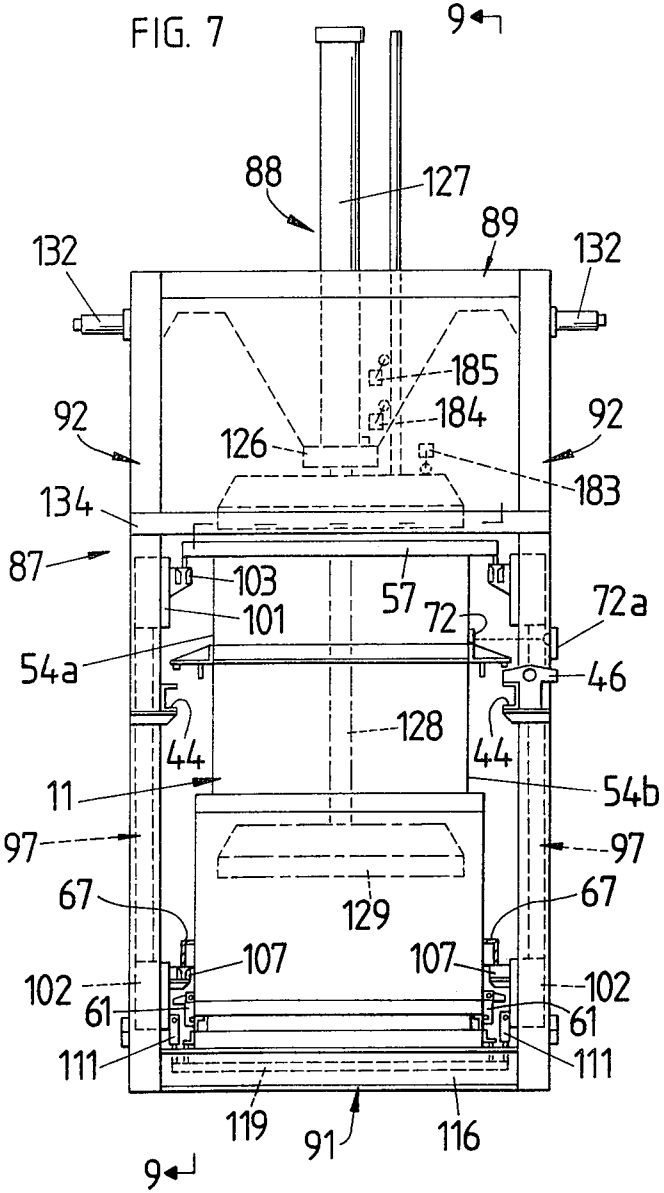
FIG. 7 is an enlarged, fragmental view taken generally along the line 7—7 of FIG. 5.

As shown in FIGS. 10 and 11, an actuating member 114, which preferably is in the form of a double acting hydraulic cylinder, is mounted within each side column 92. The actuating members 114 are operatively connected to the programmable controller 24 and impart movement to the bin actuating frames 97 selectively to an upper position and to a lower position. When a bin 11 is inserted into the compression station 27 with its bottom platen 59 engaging the bottom sill 91, the actuating members 114 move the actuating frames 97 upwardly a short vertical distance which causes the bin lifting members 103 and 107 to engage and move within the downwardly opening notches 69 and 68, respectively. This causes the bin 11 and is detachable platen 59 to be shifted horizontally relative to the path of travel of the movable ram 88 to a predetermined horizontal position within the compression station. That is, as the lifting members 103 and 107 engage the notches 69 and 68 respectively, the portable bin 11 is moved to a position which permits the down-packing movable ram 88 to enter the portable bin and selectively precompress and apply final compression to the waste fibers in the bin. After final compression, the actuator members 114 raise the actuating frames 97 whereupon the unlatching members 111 engage and disconnect the locking members 61 from the locking clips 63. This disconnects the sidewalls of the portable bin 11 from its bottom platen 59. Further upward movement of the actuating members 114 raise the bin actuating frames 97 and the side walls of the portable bin 11 to their upper positions which exposes the bale and permits the bale ties 83 to be placed around the compacted final bale, as shown in FIG. 14. After the bale is removed from the compression station 27, the actuator members 114 lower the actuating frames 97 and the side walls of the portable bin to a lower position wherein the side walls are reconnected to the bottom platen 59, as shown in FIGS. 7 and 10.

In FIGS. 7–12, we show the bottom sill 91 for the main frame 87 as comprising a pair of spaced apart wide flange beams 116 extending between the side columns 92. A plate-like member 117 covers the space between the upper flanges of the beams 116 and supports a pair of spring-loaded pins 118 adjacent each side column 92 for vertical movement through openings in the plate-like member 117 as shown in FIGS. 10 and 11. The pins 118 are adapted to move into alignment with the slots 86 in the angle-like members 84 carried by each detachable platen 59 each time a portable bin is shifted to the predetermined horizontal position in the compression station. A generally U-shaped bar-like member 119 having a base connected to upstanding legs 121 is operatively connected to and supported by the spring loaded pins 118, as shown in FIGS. 10–12. The legs 121 of the U-shaped member 119 project upwardly through openings **121*a* in the plate-like member 117 and are aligned with the unlatching members 111 carried by the lower bin lifting boxes 102, as shown. When the bin actuating frames 97 are moved upwardly a short vertical distance to align the portable bin 11 in the predetermined horizontal position in the compression station, the spring-loaded pins 118 adjacent each side column 92 move upwardly and engage the slots 86 in the angle-like members 84 as shown in FIG. 11. This locks the detachable platen 59 in the predetermined horizontal position in the compression station 27. When the bin actuating frames 97 are moved from their upper positions to their lower positions, the unlatching members 111 engage and lower the legs 121 of the U-shaped member 119. This disengages the spring loaded pins 118 from the slots 86 and unlocks the detachable platen 59, as shown in FIG. 10**.

Figure 9:
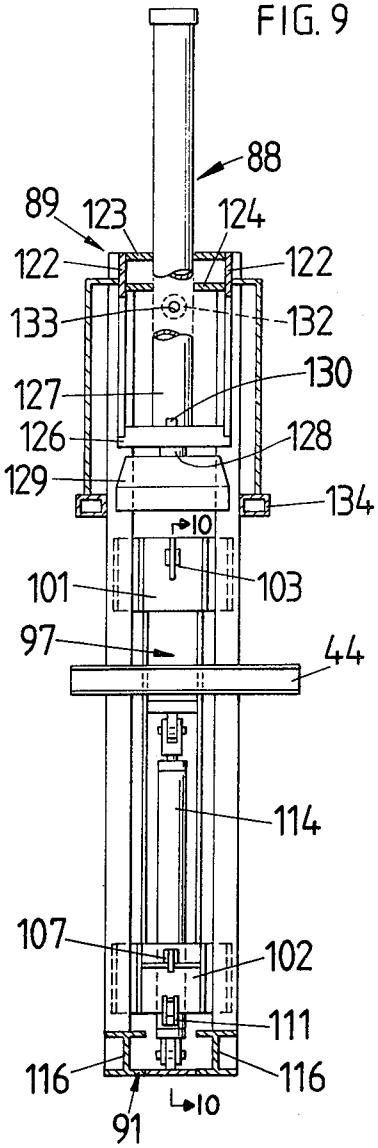
FIG. 9 is a sectional view taken generally along the line 9—9 of FIG. 7.

As described above, the upper sill 89 for the main frame 87 supports the down-packing compression ram 88 for vertical reciprocatory movement to selectively precompress and apply final compression to the waste fibers in each portable bin 11. The upper sill 89 may be constructed from a pair of spaced apart vertical plate-like members 122 and horizontal plate-like members 123 and 124 which extend between the upper end portions of the side columns 92 as shown in FIGS. 7–9. The members 122 are uniquely shaped to provide a downwardly projecting pedestal 126 which is of a size to move inwardly of the side walls of a bin 11 as it is raised to its upper position so that the compacted bale of fibers may be exposed for final bale out, as shown in FIG. 8.

The down-packing ram 88 is preferably constructed from a vertically mounted double-acting hydraulic cylinder 127 which is operatively connected to the programmable controller 24. Attached to the lower end of the piston rod 128 for the hydraulic cylinder 127 is an upper platen 129 which is of a size and shape to enter each portable bin 11 and compress the waste fibers therein. That is, the hydraulic cylinder 127 is adapted to lower the upper platen 129 within each bin 11 to precompress or apply final compression to the waste fibers to form a final bale. The cylinder 127 also raises the platen 129 to an upper position, shown in FIG. 9, which permits the bin 11 to be removed from the compression station 27.

As shown in FIG. 8, laterally spaced, downwardly opening passageways 131 are provided in the lower surface of the upper platen 129. The passageways 131 are similar in construction to the passageways 82 provided in the bottom platen 59 and aligned with the passageways 82 when the bottom platen 59 is locked in the predetermined horizontal position within the compression station 27. After final compression of the waster fibers, the passageways 131 cooperate with the passageways 82 to permit the bale ties 83 to be placed completely around the compacted bale after the bale covering materials **81*a* and 81*b*** are in place.

In FIG. 6, we show an actuator member in the form of a hydraulic chamber 132 mounted on the upper portion of each side column 92. Each cylinder 132 is operatively connected to the programmable controller 24 and is aligned with an opening 133 in its side column 92, as shown in FIG. 9. When the bin actuating frames 97 raise a bin 11 to its upper position, the programmable controller 24 causes the piston rod of each cylinder 132 to extend though the opening 133 and engage a suitable opening in the upper bin lifting box 101 adjacent thereto. This positively locks the bin actuating frames 97 and the side walls of the portable bin 11 in their upper positions, as shown in FIG. 8.

A conventional scavenger sleeve 134 is connected to the vacuum system 36 and extends around the side columns 92 of the main frame as shown in FIGS. 7–9. The scavenger sleeve 134 prevents dust, loose fibers and the like from escaping to the atmosphere during precompression of the final compression of the waste fibers. Secured to each side column 92 is a horizontally extending, channel-like guide rail 44 which supports the transfer mechanisnm 26, in a manner to be described below, each time a bin 11 is inserted and removed from the compression station 27. A generally T-shaped, vertically extending member 46 having an opening 47 therethrough and an upper cam surface 48 is also mounted on the guide rail 44 at one side of the compression station 27 as shown in FIGS. 6 and 7. A lever arm 51 is pivotally connected to the rear side of the member 46 in a manner similar to that described above relative to FIGS. 29 and 30. The lever arm 51 cooperates with the movable locking member 50 carried by the transfer mechanism 26 to lock the transfer mechanism in a predetermined position relative to the compression station 27 in the manner described above.

As shown in FIG. 7, the sensing element 72*a*, such as an electrically operated photocell, is mounted on a side column 92 in the compression station 27 and faces the end wall 54*b* of a bin 11 each time a bin is inserted into the station. The sensing element 72*a* is operatively connected to the programmable controller 24 and cooperates with the reflector 72 carried by the end wall 54*b* of each bin 11 to determine when a portable bin is moved to the predetermined horizontal position within the compression station 27. That is, when a bin 11 is inserted into the compression station and the bin actuating frames 97 move upwardly and lock the bin in the predetermined horizontal position, the sensing element 72*a* is activated by the reflector 72 and senses the presence of the bin in this position. It then conveys this information to the programmable controller 24 which signals the movable ram 88 to move downwardly into the bin to precompress or apply final compression to the waste fibers therein.

As shown in FIGS. 1–6, an overhead guide rail 137, such as an I-beam, extends between the filling stations 10 and the compression station 27. The guide rail 137 supports the transfer mechanism 26 for movement between the above mentioned predetermined positions relative to each filling station 10 and the compression station 27. A sensing element, such as a limit switch 138, is mounted on the upper flange of the guide rail 137 adjacent the mid-portion of each filling station 10 and the compression station 27. Each of the limit switches 138 is operatively connected to the programmable controller 24 and is activated by an actuator member 138*a* carried by the transfer mechanism 26 to indicate when the transfer mechanism is approaching a particular filling station 10 or the compression station 27.

Figure 22:
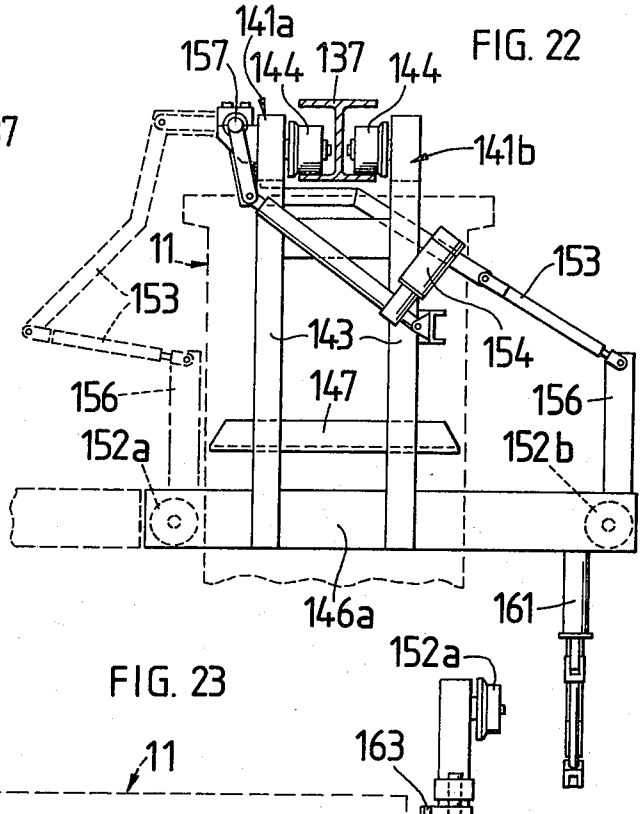
FIG. 22 is a side elevational view, partly in section, taken generally along the line 22—22 of FIG. 19.
Figure 19:
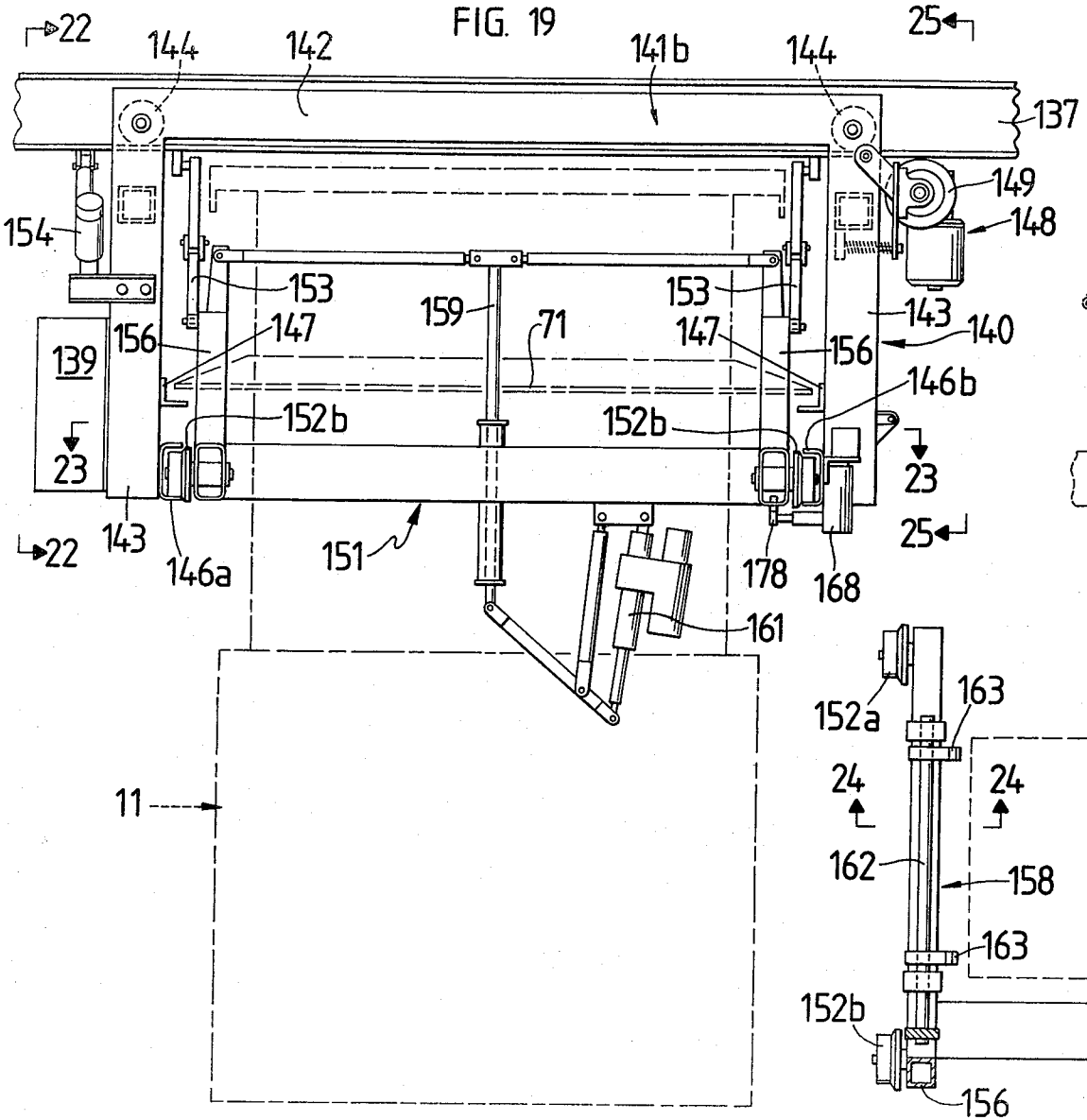
FIG. 19 is an enlarged, fragmental view taken generally along the line 19—19 of FIG. 2 showing the transfer mechanism positioned at a predetermined location relative to a filling station.

As shown in FIG. 6, a festoon cable 139 connects the programmable controller 24 to a control panel 139*a* carried by the transfer mechanism 26 in a conventional manner. The cable 139 thus permits the programmable controller 24 to control the movement of the transfer mechanism between the filling stations 10 and the compression station 27, as shown in FIGS. 1–5. The transfer mechanism 26 comprises a movable bin support frame 140 which may be constructed from two spaced apart inverted U-shaped members 141*a* and 141*b*. Each inverted U-shaped member has a base member 142 connected to spaced apart depending legs 143. As shown in FIGS. 19 and 22, a plurality of spaced apart rollers 144 are carried by the base member 142 of each inverted U-shaped member 141*a* and 141*b* in position to engage the lower flange of the guide rail 137. The rollers 144 thus support the inverted U-shaped members for movement between the above mentioned predetermined positions relative to the filling stations 10 and the compression station 27.

Figure 21:
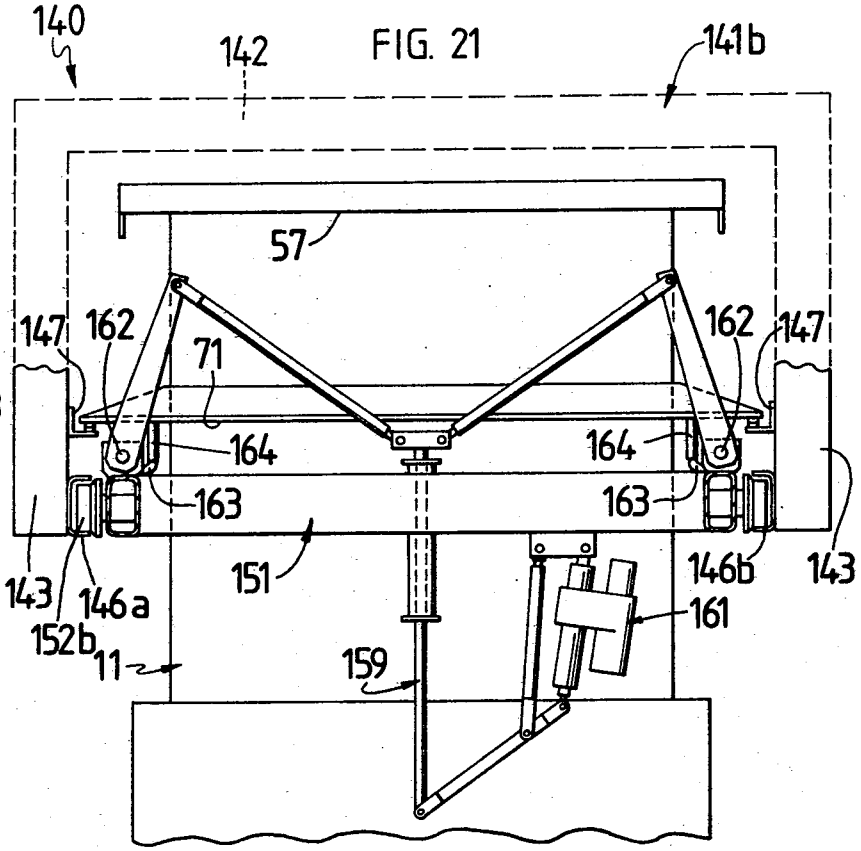
FIG. 21 is an elevational view corresponding to FIG. 20 showing the bin supported on the transfer mechanism for movement between its filling station and the compression station.

As shown in FIGS. 19–22, a pair of laterally spaced channel-like members 146*a* and 146*b* are secured to the lower portions of the legs 143 of the inverted U-shaped members. The channel members 146*a* and 146*b* are greater in length but identical, as viewed in cross section, to the above mentioned guide rails 44 mounted within each filling station 10 and within the compression station 27. The channels members 146*a* and 146*b* move into alignment with the guide rails 44 upon movement of the transfer mechanism 26 to the predetermined positions relative to filling stations 10 and the compression station 27. Laterally spaced, horizontally extending bin support rails 147 are mounted on the legs 143 of the inverted U-shaped members 141*a* and 141*b* in position to support each portable bin 11 as it is being moved between the predetermined positions relative to its filling station 10 and the compression station 27. That is, after a bin 11 is moved out of its filling station 10 or out of the compression station 27 and placed on the movable support frame 140, the horizontal flange 71 of the bin engages the bin support rails 147 as shown in FIG. 21. The movable support frame 140 then moves the bin 11 to the above mentioned predetermined positions relative to the compression station 27 and filling station 10.

As shown in FIG. 19, a drive unit 148 is mounted on one end of the movable support frame 140 and includes a wheel 149 which engages guide rail 137 and moves the movable support frame 140 between the above mentioned predetermined positions relative to the filling stations 10 and the compression station 27.

Figure 28:
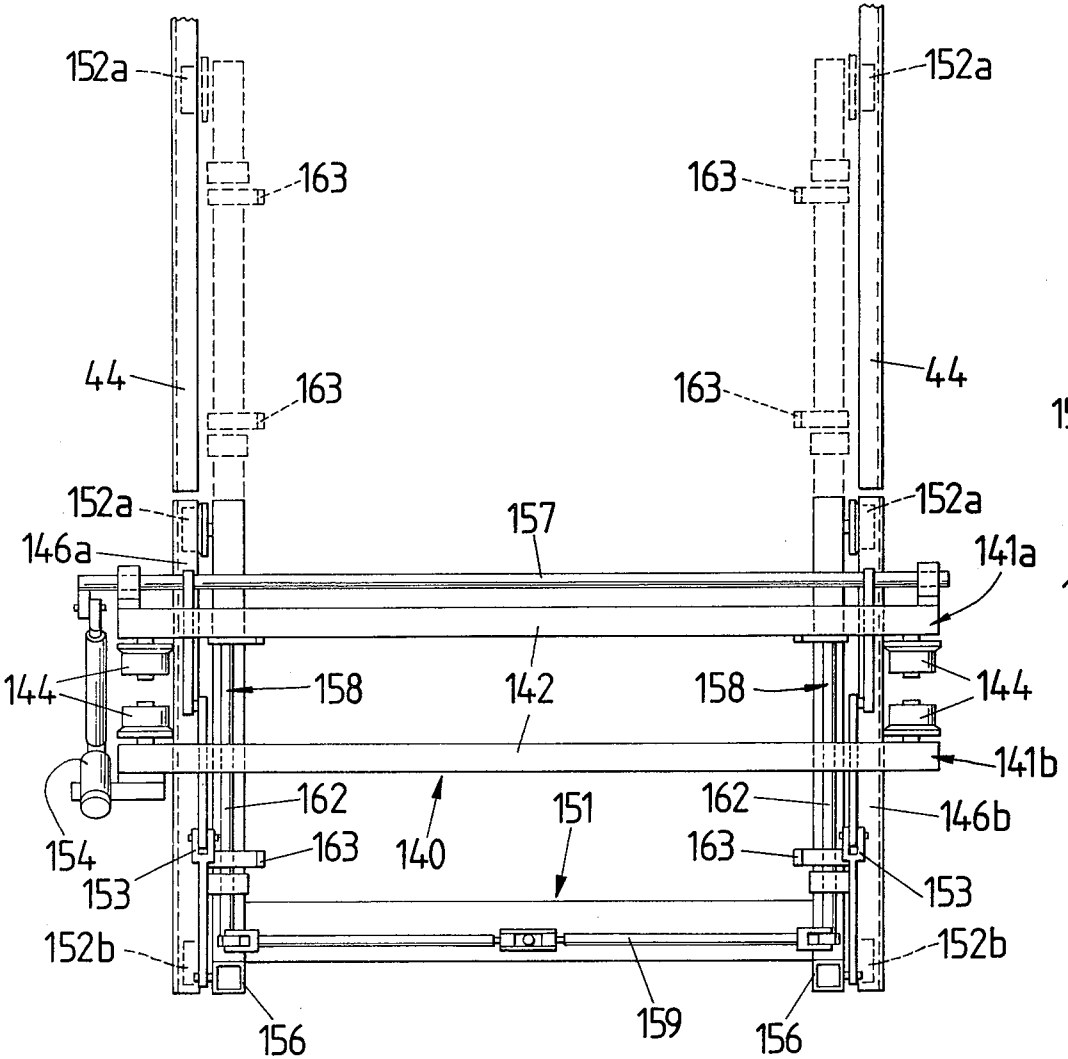
FIG. 28 is a top plan view showing the transfer mechanism in its fully extended position in dotted lines and in its fully retracted position in solid lines.

As shown in FIG. 28, a generally U-shaped bin transfer member 151 is carried by the movable support frame 140 and is adapted to engage and move each portable bin 11 into and out of its filling station 10 and into and out of the compression station 27. A pair of spaced apart rollers 152*a* and 152*b* are mounted on each leg of the bin transfer member 151 in position to engage the channel members 146*a* and 146*b* and support the movable support frame, as shown in FIGS. 19–23 and 25–28. Accordingly, as a portable bin 11 is moved from the movable support frame 140 into a filling station 10 or into the compression station 27, the front rollers 152*a* roll onto the guide rails 44 at the respective station before the bin 11 is lifted off the bin support rails 147 on the movable support frame 140. That is, the front two rollers 152*a* roll from the channel members 146*a* and 146*b* onto the aligned guide rails 44 at the respective station before the bin transfer member 151 engages the portable bin 11 carried by the movable support frame 140. The front two rollers 152*a* thus cross the gaps between the aligned channel members 146*a* and 146*b* and the guide rails 44 without transferring the weight of the bin 11 and the waste fibers carried thereby across the gaps. As the portable bin 11 is moved into its filling station 10 or into the compression station 27, the rollers 152*b* at the rear ends of the legs of the bin transfer member 151 are supported by the channel members 146*a* and 146*b*. That is, they remain in contact with channel members 146*a* and 146*b* during this entire movement.

When a portable bin 11 is moved from its filling station 10 or from the compression station 27 onto the movable support frame 140, the bin transfer member 151 moves from a fully retracted position to a fully extended position, as shown in solid lines and dotted lines, respectively, in FIG. 28. The bin transfer member 151 then engages and moves the bin 11 from the adjacent station onto the movable support frame 140 with the front rollers 152*a* remaining in contact with the guide rails 44 at the respective station during this movement. After the bin 11 is placed in a supported position on the movable support frame 140, with the horizontal flange 71 of the bin engaging the bin support rails 147, the front rollers 152*a* then roll from the guide rails 44 onto the channel members 146*a* and 146*b*. Again, it will be seen that no moving load of the bin and waste fibers therein is transferred across the spaces between the aligned channel members 146a and 146b and the guide rails 44.

As shown in FIGS. 22, and 25–28, an actuating unit comprising a pair of laterally spaced linkage assemblies 153 and an electrically operated motor 154 moves the bin transfer member 151 selectively to and from its fully retracted position and to and from its fully extended position. The linkage assemblies 153 are connected to one end to upstanding support members 156 which are carried by the base of the bin transfer member 151. The other ends of the linkage assemblies 153 are connected to a common rod-like member 157 which is mounted for rotation in suitable bearings on the base portion of the inverted U-shaped member 141a. The motor 154 is operatively connected to the programmable controller 24 and rotates the rod-like member 157 in opposite directions to move the bin transfer member 151 selectively into and out of a filling station 10 or the compression station 27, as shown in FIGS. 26 and 27.

Figure 23:
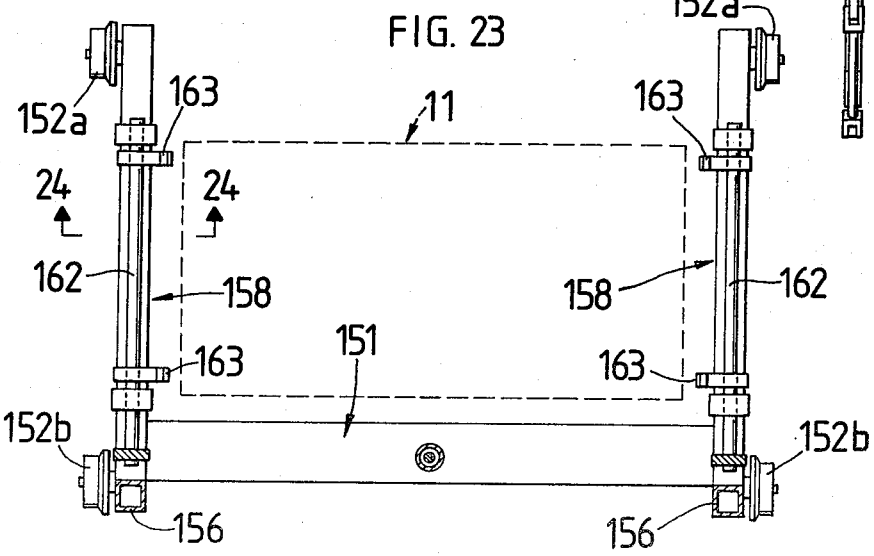
FIG. 23 is a top plan view, partly in section, taken generally along the line 23—23 of FIG. 19.
Figure 20:
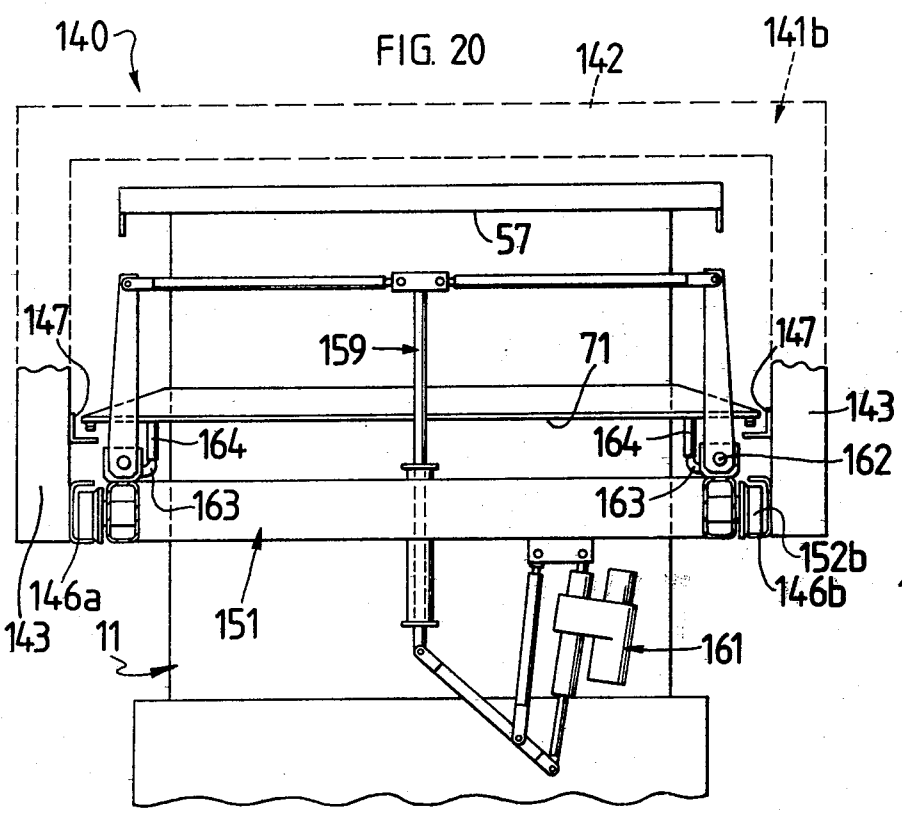
FIG. 20 is an elevational view corresponding to FIG. 19 showing the transfer mechanism elevating the bin to a position which permits movement thereof into or out of its filling station or the compression station.
Figure 24:
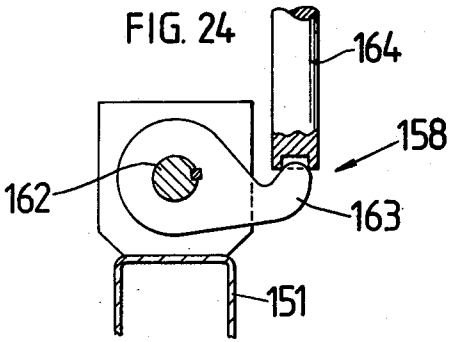
FIG. 24 is an enlarged, fragmental sectional view taken generally along the line 24—24 of FIG. 23.

In FIGS. 23 and 28, we show a bin actuating unit 158 mounted on the upper surface of each leg of the U-shaped bin transfer member 151. The actuating units 158 are operatively connected to each other through a linkage assembly 159 and an air cylinder 161, as shown in FIGS. 19, 20 and 21. Each actuating unit 158 comprises an elongated rod-like member 162 which is mounted for rotation on the leg of the U-shaped bin transfer member 151 adjacent thereto. Fixedly secured to each rod-like member 162 is a pair of longitudinally spaced lifting lugs 163 which are adapted to engage depending lifting elements 164 carried by the horizontal flange 71 of each bin 11 as shown in FIG. 24. The air cylinder 161 is operatively connected to the programmable controller 24 and moves the linkage assembly 159 to the position shown in FIG. 20 when the programmable controller signals that a particular bin is to be moved from its filling station. That is, as the air cylinder 161 extends it rotates the rod-like members 162 which cause the lifting lugs 163 to engage the lifting elements 164 and lift the bin 11 out of engagement with the bin support rails 42 in the filling station 10. This permits the bin transfer member 151 to move the bin 11 out of its filling station, as shown in FIG. 26.

When the bin transfer member 151 moves a bin 11 into its filling station 10 or into the compresssion station 27 or places it in a supported position on the movable support frame 140, the air cylinder 161 moves the linkage assembly 159 to the position shown in FIG. 21. This causes the air cylinder 161 to lower the bin into engagement with the bin support rails 42 or 147 or into engagement with the lower sill 91 in the compression station 27. Continued movement of the air cylinder 161 in this same direction disengages the lifting lugs 163 from the lifting elements 164 and permits the bin transfer member 151 to retract from the filling station or from the compression station.

As shown in FIGS. 29–31, a locking unit, indicated generally at 166, is mounted on the channel member 146b. The locking unit 166 comprises an extensible rod-like member 50 which is carried by the channel member 146b in position to move into alignment with the opening 47 in each of the vertically extending members 46 each time the transfer mechanism 26 moves to a predetermined position, as described above, relative to a filling station 10 or the compression station 27. An air cylinder 168 is operatively connected to the programmable controller 24 and extends the rod-like member 50 into engagement with the opening 47, as shown in FIG. 30. This positively locks the transfer mechanism 26 in the predetermined position relative to the compression station 27 or relative to a filling station 10. The air cylinder 168 is also adapted to retract the rod-like member 50 to a position out of engagement with the opening 47. This permits the transfer mechanism 26 to move between the predetermined positions relative to the filling stations 10 and the compression station 27.

As shown in FIGS. 29–31, a vertical member 169 extends laterally and outwardly from the front end portion of the channel member 146b. An opening 171 is provided through the vertical member 169 in position to support the front end portion of the rod-like member 50 and align it with the opening 47 in the vertically extending member 46 adjacent thereto each time the transfer mechanism 26 moves to the predetermined position relative to a filling station 10 or relative to the compression station 27.

Pivotally connected to the upper portion of the vertical member 169 is a cam roller latch assembly 172 which carries a laterally extending cam follower 173 that engages the cam surface 48 on the vertically extending member 46 each time the transfer mechanism 26 moves to the predetermined positions relative to the compression station 27 or a filling station 10. A depending index finger 174 is carried by the latch assembly 172 in position to disengage serrations 176 provided in the front portion of the rod-like member 50 each time the cam follower 173 rides upwardly on the cam surface 48, as shown in FIG. 32. This permits the air cylinder 168 to extend the rod-like member 50 into engagement with the opening 47 in the vertically extending member 46. As shown in FIG. 33, a spring-like member 177 urges the depending index finger 174 into engagement with the serrations 176 while the rod-like member 50 is in its retracted position. This prevents undesired movement of the rod-like member 50, especially when the transfer mechanism 26 is moving between the filling stations 10 and the compression station 27.

As shown in FIGS. 29–31, a pin-like member 178 is carried by an offset linkage member 178a which is pivotally connected at one end to the front end portion of the rod-like member 50. As the rod-like member 50 moves from its retracted position, shown in FIG. 29, to its extended position, shown in FIG. 30, the pin-like member 178 pivots from a first position in engagement with an opening 179 in the lower surface of the adjacent leg of the U-shaped bin transfer member 151, to a second position out of engagement with the opening 179. While the pin-like member 178 engages the opening 179, the U-shaped bin transfer member 151 is prevented from moving into a filling station 10 or into the compression station 27. That is, while the rod-like member 50 is disengaged from the opening 47 in the vertically extending member 46, the pin-like member 178 engages the opening 179 and prevents the bin transfer member 151 from moving into the compression station 27 or into a filling station 10. When the rod-like member 50 engages the opening 47 in a vertically extending member 45 and positively locks the transfer mechanism 26 in the predetermined position relative to a filling station 10 or the compression station 27, the pin-like member 178 disengages the opening 179 and permits the bin transfer member 151 to move into a filling station 10 or into the compression station 27.

Referring now to FIGS. 6 and 8, we show five sensing elements which are preferably in the form of limit switches 181–185 mounted within the compression station 27. The limit switches are operatively connected to the programmable controller 24 and are activated when a bin is placed in the compression station 27 to selectively precompress and apply final compression to the waste fibers in the bin. That is, the limit switch 181 determines when the detachable bottom platen 59 of a bin 11 is aligned and locked in the predetermined horizonal position within the compression station 27. The limit switch 182 is activated when the bin unlatching members 111 disconnect the side walls of the bin from its bottom platen 59 to thus expose the final bale for tying out. The limit switches 183 and 184 sense the position of the movable ram 88 as it moves between an uppermost position, shown in FIG. 6, to a lowermost position, shown in FIGS. 7 and 8. That is, the limit switch 183 stops upward movement of the movable ram 88 when it reaches its uppermost position. The programmable controller 24 will only permit the transfer mechanism 26 to insert a bin 11 into the compression station 27 while the ram 88 is in its uppermost position. The limit switch 184 is utilized to stop downward movement of the movable ram 88 when it reaches its lowermost compacting position. The limit switch 185 is utilized to determine the height of the final bale by stopping downward movement of the movable ram 88 at a predetermined position above its lowermost compacting position. That is, while precompressing the fibers, the ram 88 moves to a lower compacting position than when applying final compression to the waste fibers. This insures that each final bale will be packed uniformly from top to bottom. While I have shown limit switches as the means employed to determine the height of each final bale, it will be apparent that the height may be determined by other conventional means.

In FIG. 25, we show a limit switch 187 that is carried by the channel member 146*b* in position to move into alignment with the lever arm 51 each time the transfer mechanism 26 stops at the above mentioned predetermined position relative to a filling station 10 or relative to the compression station 27. The limit switch 187 is operatively connected to the programmable controller 24 and is activated when the rod-like member 50 engages the opening 47 in a vertically extending member 46 and pivots the upper end of the lever arm 51 away from the vertically extending member 46 as shown in FIG. 30. This deenergizes the air cylinder 168 and stops the forward movement of the rod-like member 50. A second limit switch 188 is carried by the transfer mechanism 26 and is operatively connected to the programmable controller 24 to deenergize the drive unit 148 of the movable support frame 140 each time the transfer mechanism 26 moves to the predetermined position relative to a filling station 10 or relative to the compression station 27. That is, as the transfer mechanism 26 approaches a filling station 10, the cam follower 173 engages and rides upwardly on the cam surface 48 on the vertically extending member 46 adjacent thereto. As the cam follower 173 moves upwardly on the cam surface 48, it trips the limit switch 188 and deenergizes the drive unit 148. This stops the transfer mechanism 26 at the predetermined position relative to a filling station 10 or relative to the compression station 27.

From the foregoing description, the operation of our improved textile waste fiber baling system will be readily understood. When the programmable controller 24 has determined that the portable bin 11 in a particular filling station 10 has received a sufficient amount of waste fibers for precompression, it signals the transfer mechanism 26 to move to that particular filling station. As a transfer mechanism approaches the filling station 10, the cam follower 173 engages and rides upwardly on the cam surface 48 on member 46 at this filling station. Upward movement of the cam follower 173 on the cam surface 48 trips the limit switch 188 and deenergizes the drive unit 148. This stops the movable support frame 140 in the predetermined position relative to the particular filling station 10. The programmable controller 24 then signals the air cylinder 168 to extend the rod-like member 50 into engagement with the opening 47 in the member 46 carried by this station. This positively locks the transfer mechanism 26 in the predetermined position relative to the particular filling station 10.

The bin transfer member 151 then moves from its fully retracted position to its fully extended position inwardly of the filing station 10 as shown in solid and dotted lines, respectively, in FIG. 28. The air cylinder 161 then rotates the lifting lugs 163 carried by rod-like members 162 into engagement with the lifting elements 164, as shown in FIG. 24. This lifts the bin out of engagement with the bin support rails 42. With the front rollers 152*a* supported by the guide rails 44 in the particular filling station 10 and the back rollers 152*b* supported by the channel members 146*a* and 146*b* on the movable support frame 140, the bin transfer member 151 moves the bin horizontally out of its filling station and onto the transfer mechanism 26. During this movement of the bin, no moving load is transferred across the spaces between the aligned channel members 146*a* and 146*b* and the guide rails 44. That is, while the bin 11 is being moved out of its filling station, the front rollers 152*a* are supported entirely on the guide rails 44 while the rear rollers 152*b* are supported entirely by the channel members 146*a* and 146*b*. When the portable bin 11 is moved to the position shown in FIG. 26, the bin actuating units 158 lower the bin into engagement with the bin support rails 147 on the movable support frame 140. After the bin transfer member 151 retracts to its fully retracted position shown in FIG. 25, air cylinder 168 disengages the rod-like member 50 from the opening 47 as shown in FIG. 29. The transfer mechanism 26 then moves to the predetermined position relative to the compression station 27.

As the transfer mechanism 26 approaches the compression station 27, the cam follower 173 engages and rides up the cam surface 48 on the member 46 mounted within the compression station 27. As the cam follower moves upwardly on the cam surface 48, the limit switch 188 is activated and deenergizes the drive unit 148. This stops the movable support frame 140 at the predetermined position relative to the compression station 27. The air cylinder 168 then extends the rod-like member 50 into engagement with the opening 47 in the vertically extending member 46 in the compression station 27. This positively locks the transfer mechanism 26 in the predetermined position relative to the compression station 27. The programmable controller 24 then signals the bin transfer member 151 to move from its fully retracted position to an intermediate extended position, shown in FIG. 26, where the front rollers 152*a* engage the front portions of the guide rails 44 in the compression station. The bin actuating units 158 then lift the bin out of engagement with the bin support rails 147. The bin transfer member 151 then moves the bin from the transfer mechanism 26 into the compression station 27. The bin actuating units 158 then lower the bin into engagement with the lower sill 91, as shown in FIGS. 7 and 10. The programmable controller 24 then signals the bin transfer member 151 to retract. After retraction, the bin actuating members 97 move upwardly a short vertical distance to cause the bin lifting elements 103 and 107 to engage the downwardly opening notches 69 and 68, respectively. This shifts the portable bin 11 to the predetermined horizontal position in the compression station which permits the movable ram 88, upon command from the programmable controller 24, to move downwardly into the portable bin, as shown in FIG. 7. As the bin actuating frames 97 move upwardly to align the bin in the predetermined horizontal position within the compression station, the spring loaded pins 118 within the bottom sill 91 of the compression station move upwardly and engage the slots 86 in the angle-like members 84 carried by the bottom platen 59. This locks the bottom platen 59 in the predetermined position within the compression station 27 and activates the bin aligning and locking limit switch 181, as shown in FIG. 6. When a bin is aligned and locked in the predetermined position in the compression station 27, the reflector 72 activates the photocell 72*a* which signals the programmable controller 24 that the bin is in the predetermined horizontal position. The programmable controller 24 then directs the movable ram 88 to move from its uppermost inoperative position downwardly into the portable bin to precompress the waste fibers therein.

After the precompression cycle is completed, the movable ram is raised to its uppermost position, as shown in FIG. 6. The bin actuating frames 97 then move downwardly to unlock the bin and its bottom platen 59 so that the bin is free to move from the predetermined position within the compression station. That is, the unlatching members 111 carried by the lower lifting boxes 102 of the bin actuating frames 97 engage the legs 121 of the U-shaped member 119 in the lower sill 91. This lowers the spring loaded pins 118 out of engagement with the slots 86 in the angle-like members 84 mounted on the end walls 77 of the bottom platen 59. The bin transfer member 151 then moves from its fully retracted position to its fully extended position inwardly of the compression station 27. The bin actuating units 158 then engage and lift the bin out of engagement with the bottom sill 91 within the compression station. The bin transfer member 151 then moves the bin out of the compression station 27 and onto the movable support frame 140. The bin actuating units 158 then lower the bin into engagement with the bin support rails 147, as shown in FIG. 21. After the bin transfer member 151 retracts and the rod-like member 50 disengages the opening 47 in member 46, the transfer mechanism 26 moves the portable bin 11 from the predetermined position relative to the compression station 27 to the predetermined position relative to its filling station 10.

As the transfer mechanism 26 approaches the filling station 10, the cam follower 173 engages and rides upwardly on the cam surface 48 on the member 46. This trips the limit switch 188 and deenergizes the drive unit 148 whereby the movable support frame 140 is stopped at the predetermined position relative to the filling station. The air cylinder 168 then extends the rod-like member 50 into engagement with the opening 47 in the member 46 within the filling station 10 to positively lock the transfer mechanism 26 in the predetermined position as described above. The programmable controller 24 then signals the bin transfer member 151 to move from its fully retracted position, shown in solid lines in FIG. 28, to its intermediate extended position shown in FIG. 26. The bin actuating units 158 then engage and lift the bin out of engagement with the bin support rails 147 on the movable support frame 140. The bin actuating member 151 then moves the bin into its filling station 10. The bin actuating units 158 then lower the bin into engagement with the bin support rails 42 wihin the filling station. The bin transfer member 151 and the rod-like member 50 then retract to their fully retracted positions. The transfer mechanism 26 then awaits a signal from the programmable controller 24 to move to the next filling station requiring precompression or final compression of the waste fibers in its portable bin 11.

The precompression operation for each filling station 10 is repeated until the programmable controller 24 determines that sufficient waste fibers are in its portable bin 11 to form a final bale. When this occurs, the programmable controller 24 signals an operator to come to the compression station 27 and apply the bale covering material 81*b* to the upper platen 129, as shown in FIG. 8. The programmable controller 24 then signals the transfer mechanism 26 to move the selected portable bin 11 within the particular filling station 10 requiring final compaction to the compression station 27 in the same manner as described above. In the compression station, the movable ram 88 moves downward after the portable bin has been located and locked in the predetermined horizontal position as described above. At this point, however, the cycle is different in that once the ram 88 is extended, the programmable controller 24 will cause the bin actuating frames 97 in the side columns 92 to move upwardly and unlatch the bottom platen 59 from the side walls of the bin 11. Continued upward movement of the actuating frames 97 raise the sidewalls of the bin to its upper position, as shown in FIGS. 8 and 11. While in this upper position, the piston rods of the hydraulic cylinders 132 extend through the openings 133 in the side columns 92 of the main frame 87 to engage the bin actuating frame 97 and positively lock the side walls of the bin 11 and the actuating frame 97 in their upper positions. This exposes the final compacted bale so that the operator can affix the bale wrapping materials 81*a* and 81*b* and the ties 83 around the bale. When the operator completes this task, the upper platen 129 is raised to thus release the bale into its ties. The operator then removes the final bale from the compression station and applies the bale wrapping material 81*a* to the lower platen 59. After this, the bin side walls are lowered and the ram 88 is moved to its upper inoperative position. When the bin side walls have reached their lower position, the bottom platen 59 automatically relatches to the side walls of the bin and the spring loaded pins 118 disengage the slots 86 in the angle-like members 84 to thereby unlock the bin and its platen 59 for movement from the predetermined position within the compression station 27. The programmable controller 24 then causes the transfer mechanism 26 to lift and move the portable bin onto the movable support frame 140 in the same manner as described above. The transfer mechanism 26 then moves the bin 11 back to the predetermined position relative to its filling station 10 and inserts the bin into the filling station in the same manner as described above. The transfer mechanism 26 then withdraws and awaits a signal from the programmable controller 24 for the next action.

Suitable sensing means, indicated generally at 130 in FIG. 9, is provided in the compression station 27 to detect when the force compressing the fibers to a predetermined volume exceeds a predetermined amount. In the event the compressive force exceeds such predetermined amount, the sensing means 130 signals the movable ram to automatically return to its upper inoperative position to expose the sides of the bale for applying the bale restraining ties. Suitable audible or visual signaling means is operatively connected to and operable by the sensing means 130 to indicate when the force compressing the fibers exceeds a predetermined amount.

From the foregoing, it will be seen that we have devised an improved textile waste baling system which efficiently and economically segregates, precompresses and compresses textile waste fibers supplied from a plurality of separate sources into final bales of uniform size and density. By providing an improved textile waste baling system having a single transfer mechanism for moving a plurality of portable waste receiving bins selectively from their filling stations to a single compression station, we provide a system which can utilize the long time intervals resulting from the slow rates at which some waste fibers are collected to permit the single transfer mechanism to move the portable bins to the compression station for precompression and final compression without exceeding the capacity of the transfer mechanism or the single compression station.

Also, by providing a waste baling system which may be fully automated through a programmable controller, we provide a system which minimizes human exposure to textile waste fibers while at the same time it segregates a plurality of different types of waste fibers into separate groups that produce optimum resale values when compacted into final bales.

We wish it to be understood that we do not desire to be limited to the exact details of the apparatus shown and described, for obvious modifications will occur to a person skilled in the art.

What we claim is:

1. A system for compressing compactable textile waste fibers and the like supplied from a plurality of separate sources into bales comprising:

(a) a plurality of fiber filling stations for receiving said fibers from said separate sources, (b) a portable fiber receiving bin for each said filling station and adapted for movement into and out of its filling station with the upper end of each said bin being open for receiving said fibers and there being a detachable bottom platen at its lower end, (c) a compression station adapted to receive each said bin and having a movable ram disposed for vertical reciprocatory movement selectively to an upper inoperative position and to a lower compressing position to compress said fibers within said bin to form a bale, (d) transfer means interposed between each said filling station and said compression station for moving each said bin selectively from its filling station to said compression station and from said compression station to its filling station, (e) means to impart relative vertical movement between said bin and platen and a support member carried by said compression station upon movement of said bin into said compression station by said transfer means, and (f) means carried by said compression station to raise said bin and thus expose the sides of said bale with said bottom platen of said bin remaining in a lower position.

2. A system as defined in claim 1 in which each said filling station includes means for stopping flow of said waste fibers from said filling station while its bin is removed from its filling station.

3. A system as defined in claim 1 in which said transfer means includes a transfer unit having locking means for positively locking said transfer unit in a predetermined position relative to each said filling station and in a predetermined position relative to said compression station.

4. A system as defined in claim 3 in which said locking means also limits movement of said transfer unit into and out of each said filling station and into and out of said compression station respectively until said transfer unit is positively locked selectively at said predetermined position relative to each said filling station and at said predetermined position relative to said compression station.

5. A system as defined in claim 4 in which said transfer means also includes means to stop said transfer unit at each said predetermined position relative to each said filling station and said compression station.

6. A system as defined in claim 4 in which said locking means comprises a movable locking member carried by said transfer unit in position to move selectively into alignment with and engage a locking element mounted within each said filling station and within said compression station in response to movement of said transfer unit to said predetermined position relative to each said filling station and said compression station.

7. A system as defined in claim 6 in which said locking element is defined by an opening through a vertical member and said locking member is an extensible rod-like member adapted for movement selectively in one direction to engage said opening and lock said transfer unit at said predetermined positions and in a reverse direction to disengage said opening and permit movement of said transfer unit to and from said predetermined positions.

8. A system as defined in claim 6 in which said locking means also includes a pin-like member operatively connected to said locking member and adapted for movement selectively in one direction to engage said transfer unit and limit movement thereof into and out of each said filling station and said compression station while said locking member is disengaged from said locking element and in a reverse direction to disengage said transfer unit and permit movement thereof while said locking member engages said locking element.

9. A system as defined in claim 3 in which said transfer unit includes means for lifting and lowering each said bin while said transfer unit is positively locked selectively in each said predetermined position relative to each said filling station and said compression station.

10. A system as defined in claim 9 in which said transfer unit comprises, (a) a movable support frame adapted to support and move each said bin selectively to and from said predetermined positions relative to its filling station and relative to said compression station, and (b) a bin transfer member carried by said movable support frame and adapted to engage and move each said bin selectively into and out of its filling station and into and out of said compression station while said movable support frame is positively locked at said predetermined positions relative to its filling station and said compression station.

11. A system as defined in claim 10 in which a pair of laterally spaced, horizontally extending guide rails is carried by said movable support frame in position to extend alongside and support said bin transfer member for movement selectively into and out of each said filling station and said compression station.

12. A system as defined in claim 11 in which said guide rails carried by said movable support frame are positioned in alignment with and terminate in closely spaced relation to a pair of laterally spaced, horizontally extending guide rails mounted within each said filling station and within said compression station in response to movement of said movable support frame selectively to said predetermined positions relative to each said filling station and said compression station.

13. A system as defined in claim 12 in which said bin transfer member comprises, (a) a horizontally extending generally U-shaped member having a base connected to spaced apart legs, and (b) a plurality of guide members mounted on each said leg of said U-shaped member in position to engage said guide rails carried by said movable support frame and to engage said guide rails within each said filling station and within said compression station upon movement of said U-shaped member selectively into and out of each said filling station and said compression station.

14. A system as defined in claim 13 in which said guide members are arranged on the legs of said U-shaped member in positions for said U-shaped member to move each said bin selectively into and out of its filling station and into and out of said compression station without transferring the weight of said bin across the space between adjacent ends of said guide rails while said guide rails are aligned with each other.

15. A system as defined in claim 13 in which said means for selectively lifting and lowering each said bin while said transfer unit is positively locked at said predetermined positions adjacent each said filling station and said compression station comprises, (a) an elongated rod-like member mounted for rotation on each said leg of said U-shaped member, (b) at least one laterally projecting element fixedly secured to each said rod-like member in position to selectively engage and lift each said bin relative to said U-shaped member to a position for movement selectively into and out of its filling station and into and out of said compression station in response to rotation of said rod-like member in one direction and to lower and disengage said bin after movement thereof selectively into its filling station and into said compression station in response to rotation of said rod-like member in a reverse direction, and (c) actuator means for rotating said rod-like members in said one direction and in said reverse direction.

16. A system as defined in claim 10 in which at least one elongated guide rail extends along a predetermined path between said filling stations and said compression station to support said movable support frame for movement between said predetermined positions relative to each said filling station and said compression station.

17. A system as defined in claim 3 in which fiber volume measuring means is operatively connected to each means for supplying said fibers from each said separate source and to said transfer unit to cause said transfer unit to move a bin from its filling station to said compression station in response to delivery of a predetermined volume of said fibers to said bin for selectively precompressing and applying final compression to said fibers to form a bale.

18. A system as defined in claim 3 in which fiber level sensing means is operatively connected to the bin at each filling station and to said transfer unit to signal movement of each bin from its filling station to said compression station in response to fiber build-up in each bin to a predetermined level for precompressing and applying final compression to said fibers to form a bale.

19. A system as defined in claim 1 in which actuator means carried by said compression station is adapted to move each said bin selectively to an upper position with said bin disconnected and spaced from said bottom plate and to a lower position with said bin connected to said bottom platen.

20. A system as defined in claim 19 in which said movable ram includes a hydraulic cylinder having a depending piston rod with said cylinder being supported by an upper frame extending across an upper portion of said compression station with a portion of said upper frame extending downwardly around said cylinder and being of a size to occupy space within the confines of the walls of said bin as said actuator means moves said bin to said upper position.

21. A system as defined in claim 19 in which said actuator means also includes means to position each said bin at a predetermined position relative to said movable ram while said bin is connected to its platen to permit said movable ram to move from its upper inoperative position above the upper end of a bin to its lower compressing position within the bin.

22. A system as defined in claim 19 in which sensing means is operatively connected to said actuator means and to said movable ram to actuate said movable ram so that it moves from its upper inoperative position to its lower compressing position in response to sensing that a bin is held in said predetermined position within said compression station by said actuator means.

23. A system as defined in claim 22 in which said sensing means is also operatively connected to said transfer means to prevent it from inserting a fiber receiving bin into said compression station while said ram is in said lower compression position and while another bin is in said compression station.

24. A system as defined in claim 19 in which said compression station includes means for locking each said bin at said upper position.

25. A system as defined in claim 24 in which said compression station also includes means to lock each said platen in a predetermined position within said compression station while said bin is moved to said upper position.

26. A system as defined in claim 25 in which latch means is carried by the lower portion of each said bin in position to detachably connect said bin to its platen while in said lower position.

27. A system as defined in claim 26 in which said actuator means also includes means to disconnect said latch means in response to energizing said actuator means prior to movement of said bin to said upper position.

28. A system as defined in claim 27 in which said actuator means also includes means that disengages said means to lock each said platen in said predetermined position within said compression station in response to downward movement of said bin to its lower position.

29. A system as defined in claim 1 in which sensing means operatively connected to each said fiber receiving bin detects when each said bin reaches its volumetric capacity and automatically signals said transfer means to move said bin from said filling station to said compression station, and sensing means in said compression station detects the presence of said bin in the compression station and automatically signals said movable ram to move downward to said lower compressing position to compress said fibers to a predetermined volume.

30. A system as defined in claim 29 in which sensing means in said compression station signals said movable ram to automatically return to said upper inoperative position upon compressing said fibers to said predetermined volume, and sensing means is mounted in position to be actuated by said movable ram when said ram reaches its upper inoperable position to signal said transfer means to automatically move said bin from said compression station to its filling station.

31. A system as defined in claim 29 in which sensing means in said compression station detects when the force compressing said fibers to said predetermined volume exceeds a predetermined amount.

32. A system as defined in claim 31 in which said sensing means detecting when said force exceeds said predetermined amount actuates said means carried by said compression station to raise said bin and expose the sides of said bale.

33. A system as defined in claim 31 in which signaling means is operatively connected to and operable by said sensing means detecting when said force compressing said fibers to said predetermined volume exceeds said predetermined amount.

34. A system as defined in claim 1 in which said transfer means comprises, (a) means to move said bins in a path that passes adjacent each filling station and said compression station, and (b) means to move said bins in and out of said filing stations and said compression station in a direction substantially perpendicular to said path that passes adjacent said stations.

35. A system as defined in claim 34 in which means is provided to prevent movement of said bins along said path adjacent said stations if said means to move said bins in and out of said stations is not moved fully to its out position.

36. A system as defined in claim 34 in which means is provided to prevent movement of said bins in and out of said stations if the transfer means is not aligned with a station along said path that passes adjacent each station.

37. A system as defined in claim 1 in which means is provided to permit downward movement of said ram only when there is selectively no bin in said compression station and there is a bin accurately positioned horizontally in the compression station.

* * * * *